US006962372B2

(12) United States Patent
Fabel et al.

(10) Patent No.: US 6,962,372 B2
(45) Date of Patent: Nov. 8, 2005

(54) DOCUMENT ENCLOSURE MAILING FORM FOR NON-IMPACT PRINTING

(75) Inventors: Warren M. Fabel, Boca Raton, FL (US); Glen A. Auchter, Parkland, FL (US)

(73) Assignee: Laser Substrates, Inc., Boca Raton, FL (US)

( * ) Notice: Subject to any disclaimer, the term of this patent is extended or adjusted under 35 U.S.C. 154(b) by 0 days.

(21) Appl. No.: 10/752,477

(22) Filed: Jan. 6, 2004

(65) Prior Publication Data

US 2004/0195822 A1 Oct. 7, 2004

Related U.S. Application Data

(63) Continuation-in-part of application No. 09/557,492, filed on Apr. 24, 2000, now Pat. No. 6,672,624, which is a continuation-in-part of application No. 09/243,003, filed on Feb. 2, 1999, now Pat. No. 6,173,888, which is a continuation-in-part of application No. 08/480,161, filed on Jun. 7, 1995, now Pat. No. 5,865,717, which is a division of application No. 08/240,869, filed on May 10, 1994, now abandoned, said application No. 09/557,492, is a continuation-in-part of application No. 09/132,036, filed on Aug. 11, 1998, now Pat. No. 6,155,476, which is a continuation-in-part of application No. 08/434,416, filed on May 3, 1995, now Pat. No. 5,791,553, application No. 10/752,477, which is a continuation-in-part of application No. 09/864,753, filed on May 24, 2001, now Pat. No. 6,481,754, which is a continuation-in-part of application No. 09/488,067, filed on Jan. 19, 2000, now Pat. No. 6,482,085, which is a continuation-in-part of application No. 09/179,224, filed on Oct. 27, 1998, now Pat. No. 6,095,919.

(51) Int. Cl.[7] ..... B42D 15/00

(52) U.S. Cl. ..... 283/116; 229/68.1; 283/101; 283/105

(58) Field of Search ..... 283/116, 61, 62, 283/81, 101, 105; 229/68.1, 300, 303, 70, 72

(56) References Cited

U.S. PATENT DOCUMENTS

| | | | | | |
|---|---|---|---|---|---|
| 3,229,893 | A | * | 1/1966 | Stein | 229/301 |
| 5,314,110 | A | * | 5/1994 | Lombardo | 229/92.1 |
| 5,464,255 | A | * | 11/1995 | Schildmeyer | 283/116 |
| 5,487,566 | A | * | 1/1996 | Hedge, Jr. | 283/56 |
| 5,622,390 | A | * | 4/1997 | Jenkins | 283/116 |
| 5,687,904 | A | * | 11/1997 | Potter | 229/303 |

* cited by examiner

*Primary Examiner*—Willmon Fridie, Jr.
(74) *Attorney, Agent, or Firm*—Jon A. Gibbons; Fleit, Kain, Gibbons, Gutman, Bongini & Bianco P.L.

(57) ABSTRACT

A mailing form for facilitating the mailing of a document is disclosed. The mailer comprises a ply having a front face and a back face, wherein the ply includes a first panel, a second panel, a third panel and a fourth panel of substantially the same area, each panel separated by a fold line. The mailer further includes a document in the third panel and the fourth panel and a first fold line between the third panel and the fourth panel. The mailer further includes a second fold line between the second panel and the third panel and a third fold line between the first panel and the second panel. The mailer further includes adhesive that secures the mailing form in folded form.

14 Claims, 20 Drawing Sheets

DOCUMENT ENCLOSURE MAILING FORM FOR NON-IMPACT PRINTING

CROSS-REFERENCED APPLICATIONS

This present U.S. Patent Application is a continuation-in-part of U.S. patent application Ser. No. 09/557,492, filed Apr. 24, 2000, now U.S. Pat. No. 6,672,624, which is a continuation-in-part of U.S. patent application Ser. No. 09/243,003, filed Feb. 2, 1999, now U.S. Pat. No. 6,173,888, which is a continuation-in-part of U.S. patent application Ser. No. 08/480,161, filed Jun. 07, 1995, now U.S. Pat. No. 5,865,717, which is a divisional of U.S. patent application Ser. No. 08/240,869, filed May 10, 1994 now abandoned, and U.S. patent application Ser. No. 09/557,492 is also a continuation-in-part of U.S. patent application Ser. No. 09/132,036, filed Aug. 11, 1998, now U.S. Pat. No. 6,155,476, which is a continuation-in-part of U.S. patent application Ser. No. 08/434,416, filed May 3, 1995, now U.S. Pat. No. 5,791,553. Also, this present U.S. Patent Application is a continuation-in-part of U.S. patent application Ser. No. 09/864,753 filed May 24, 2001, now U.S. Pat. No. 6,481,754, which is a continuation-in-part of U.S. patent application Ser. No. 09/488,067, filed Jan. 19, 2000, now U.S. Pat. No. 6,482,085, which is a continuation-in-part of U.S. patent application Ser. No. 09/179,224 filed Oct. 27, 1998, now U.S. Pat. No. 6,095,919. The aforementioned U.S. Patents and U.S. Patent Applications are herein incorporated by reference in their entirety.

FIELD OF THE INVENTION

This invention generally relates to the field of mailing forms and more specifically to mailing forms that, after information has been printed thereon by a simplex, non-impact printer, can be folded into an outgoing mailer containing a printed document.

DESCRIPTION OF RELATED ART

As technology progresses, the business office is becoming more and more automated. Faxes, file servers, email, teleconferencing and cell phones have revolutionized the way firms do business. Mailers, in particular, have enjoyed increasing popularity. A mailer is a consumable paper product that allows for quick and easy printing and mailing of information. A mailer can include an envelope, an insert and a return envelope, which may be created by folding the original document. For example, mailers are used to send account statements, invoices, checks, and tax forms to customers and employees of a business. The commonly owned U.S. Patents and U.S. Patent Application described above provide more information on mailers. A mailer allows a firm or business to print directly onto one product all of the information necessary for mailing to a customer, client or employee. This is advantageous as it eliminates the separate printing of an envelope, an insert and a return envelope, as well as the need for the insertion of the return envelope and the insert into the envelope. Mailers, however, do not come without their drawbacks.

One problem with the use of a mailer is producing the mailer. Mailers often require folding and sealing before sending out. Current folding/sealing machines are bulky and costly. Thus, businesses are forced to buy additional equipment, apart from software and printers, in order to produce a mailer. This is cost prohibitive for many businesses. Therefore, a need exists to provide a cost effective method of producing mailers for small and medium businesses.

Another problem with the production of mailers is that current mailers require duplex or multiple pass printers. This is disadvantageous, as the current installed base of printers substantially comprises simplex or single pass printers. It would be advantageous for mailers to support the current installed base of single pass printers, as it is cost effective for those recipients to continue using their current printers, as opposed to purchasing new printers. Therefore, a need exists for mailers that support simplex or single pass printers.

Non-impact printers, such as laser or ink jet printers, are being increasingly used to provide a fast, economical, and convenient method of printing data on various media, including mailers. Multi-part forms, including envelopes in which documents are sent, together with the documents themselves, have been manufactured for use in impact printers. Such forms are typically assembled into webs with sprocket holes extending along one or both lateral edges to facilitate handling through a pin feed impact printer. Transferable coatings are selectively placed on one or more of the sheets making up the assembly, so that impact-printing forces are transferred to produce characters on intermediate document surfaces. This approach has further been modified to provide a remittance envelope, in which various materials, such as a check and a portion of the statement, may be returned to the organization sending the statement.

However, with the increasing popularity of non-impact printers, especially among small business organizations, the percentage of organizations having the impact printers necessary to use such multi-part forms is decreasing. Therefore, what is needed is a mailer configured for use with non-impact printers. However, by simply adapting the standard available technologies to produce forms that can be used with non-impact printers results in forms that do not have flexibility and the capability for efficient use with non-impact printers. For example, mailers produced by machine-fold and seal technologies available in the 1980s and 1990s were often burdensome or clumsy to open. A perforated strip had to be removed from at least three, and sometimes four, sides of the mail piece. At least two of these strips ran at right angles to the paper grain whereby perforations are least effective for providing a clean tear.

Furthermore, previously available mailers often must be processed through automatic folding/sealing machines to be used in a practical manner. Such automatic folding machines are examples of equipment not available to many small business organizations. Additionally, recipients of the prior-available mailers usually do not read opening instructions printed on the exterior of the mailer. This resulted in frustration on the part of the recipient as well as damage or destruction of the contents of the mailer. This is especially problematic when the contents include a check.

Furthermore, none of these previous embodiments described above allowed for printing of PC postage on a simplex printer. Each PC postage indicia is unique and therefore cannot be pre-printed.

Therefore, a need exists to overcome the problems with the prior art as discussed above.

SUMMARY INVENTION

Briefly, in accordance with the present invention, disclosed is a mailing form for facilitating the mailing of a document. In an embodiment of the present invention, the mailing form includes a ply having a front face and a back face, wherein the ply includes a first panel, a second panel, a third panel and a fourth panel of substantially the same area, each panel separated by a fold line. The mailing form further includes a document in the third panel and the fourth panel and a first fold line between the third panel and the fourth panel that allows the fourth panel to be folded so that the back face of the fourth panel contacts the back face of the third panel. The mailing form further includes a second fold line between the second panel and the third panel that allows the third panel to be folded so that the front face of the third panel contacts the front face of the second panel and a third fold line between the first panel and the second panel that allows the first panel to be folded so that the front face of the first panel contacts the front face of the fourth panel. The mailing form further includes adhesive that secures the mailing form in folded form.

In an embodiment of the present invention, the third fold line between the first panel and the second panel allows the first panel to be folded so that the front face of the first panel contacts the front face of the second panel. When the mailing form is folded along the third fold line so that the front face of the first panel contacts the front face of the second panel, information can be printed onto the back face of the first panel, the front face of the third panel and the front face of the fourth panel.

In yet another embodiment of the present invention, the mailing form further includes a first perforation along the top edge of the first panel, spanning the entire length of the first panel and a second perforation along the bottom edge of the second panel, spanning the entire length of the second panel. The mailing form further includes a third perforation along the top edge of the third panel, spanning the entire length of the third panel and a fourth perforation along the first fold line. When the mailing form is folded along the first fold line, folded along the second fold line, and folded along the third fold line such that the front face of the first panel contacts the front face of the fourth panel, the first perforation, the second perforation and the third perforation are aligned.

In yet another embodiment of the present invention, a mailing form for facilitating the mailing of a document includes a ply having a front face and a back face, wherein the ply includes a first panel, a second panel, a third panel, a fourth panel and a fifth panel of substantially the same area, each panel separated by a fold line. The mailing form further includes a document in the third panel, the fourth panel and the fifth panel and a first fold line between the fourth panel and the fifth panel that allows the fifth panel to be folded so that the front face of the fourth panel contacts the front face of the fifth panel. The mailing form further includes a second fold line between the third panel and the fourth panel that allows the fourth panel to be folded so that the back face of the fourth panel contacts the back face of the third panel and a third fold line between the second panel and the third panel that allows the third panel to be folded so that the front face of the third panel contacts the front face of the second panel; The mailing form further includes a fourth fold line between the first panel and the second panel that allows the first panel to be folded so that the front face of the first panel contacts the back face of the fifth panel and adhesive that secures the mailing form in folded form.

The features of the present invention are advantageous as all printed information is printed on one face of the mailer (when the mailer is in a folded form) and thus it allows the mailer to be printed in a typical sheet-fed non-impact printer. Additionally, certain embodiments allow the postage indicia and Facing Identification Mark to be printed within ⅛ of an inch of the top edge of an envelope, as required by the U.S. Postal Service (USPS).

Another advantage of the present invention is that it results in at least one document being situated between layers of paper of the mailer. The documents and are sealed along the edges by adhesives contacting receiving areas of the first panel and the second panel. This produces a robust envelope that carries the documents and is able to survive the rigors of mail processing by the USPS and other entities.

Another advantage of the present invention is that the mailer is easily printable by a standard non-impact printer. Printing of the mailer does not require the adjustment of the printer. This is beneficial to the consumer as it results in a more efficient printing process.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings.

DETAILED DESCRIPTION OF THE PREFERRED EMBODIMENTS

Figure 1A:
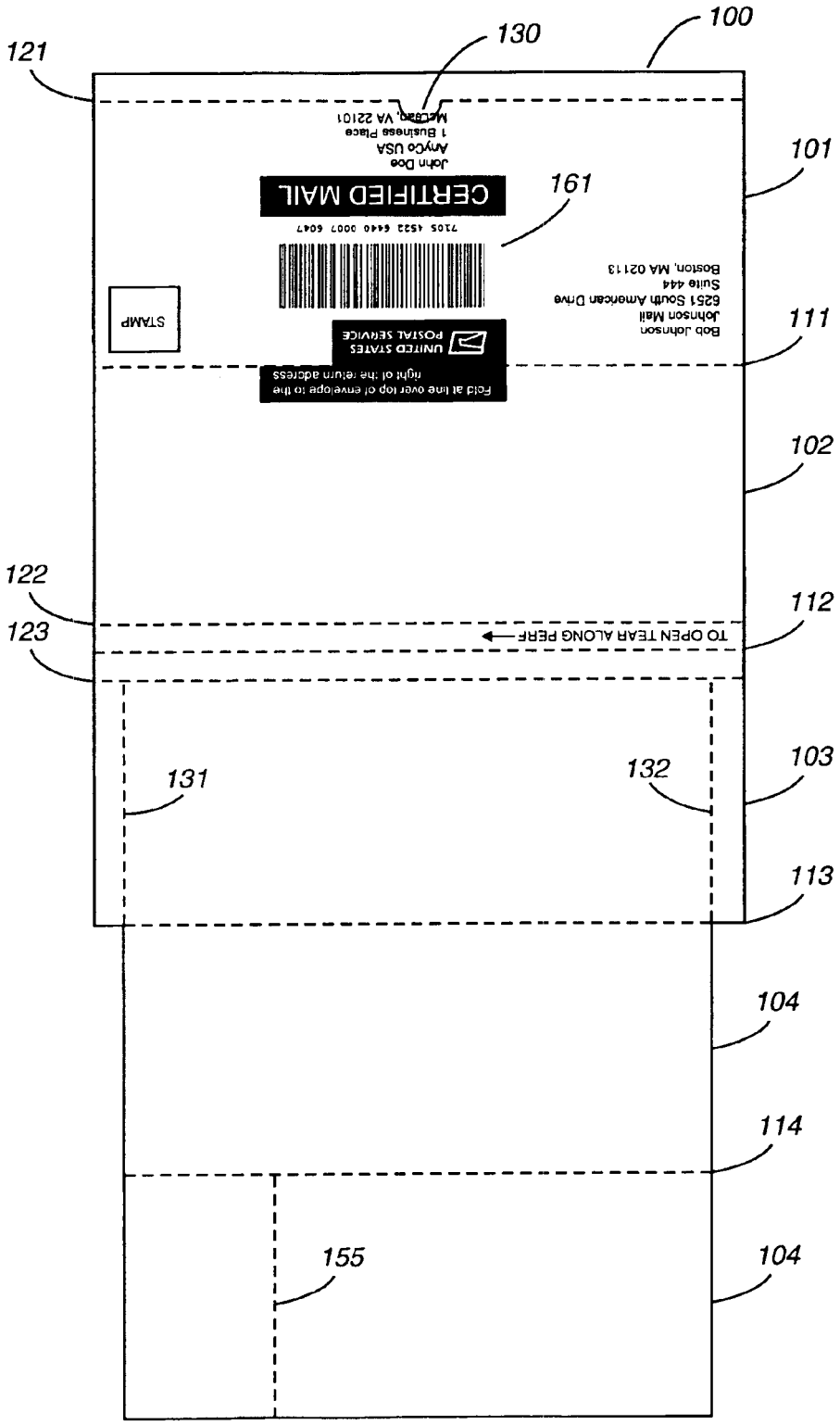
FIG. 1A shows a top view of the front of a five-panel certified mailing form including a letter and a certified mail indicator (e.g., a sticker), in one embodiment of the present invention.

It should be understood that these embodiments are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and vice versa with no loss of generality. In the drawing like numerals refer to like parts through several views.

The present invention solves the problems with the prior art by providing a mailer that (a) provides a combination outgoing mailer envelope and a document (b) is easily opened and allows for convenient extraction of the contents, (c) can be simplex printed to include all addressing, check information, and MICR encoding and electronic PC postage, including Information-Based Indicia (IBI) and FIM indicia and automatic positioning of same, in a single pass through the simplex printer, and (d) provides these in a mailing form which can be sealed by adhesive sealing means.

FIG. 1A shows a top view of the front of a five-panel certified mailing form including a letter and a certified mail indicator, in one embodiment of the present invention. FIG. 1A shows that the mailing form, or mailer, comprising a ply, which is a rectangular sheet of paper having dimensions of a standard sheet of paper, e.g., 8.5×11 inches, 8.5×14 inches or A4. It is important to note, that other paper dimensions are possible to those skilled in the art, within the true scope and spirit of the present invention. The ply is composed of any number of paper materials and composites that are used as paper substitutes. Either side of the ply can receive printed information when passed through a simplex non-impact printer.

FIG. 1A shows a first panel 101, a second panel 102, a third panel 103, a fourth panel 104 and a fifth panel 105, all of substantially the same area. A fold line separates each panel. The first panel 101 and the second panel 102 are separated by a fold line 111, the second panel 102 and the third panel 103 are separated by a fold line 112, the third panel 103 and the fourth panel 104 are separated by a fold line 113 and the fourth panel 104 and the fifth panel 105 are separated by a fold line 114.

FIG. 1A also shows a perforation 101 extending across the top edge and the entire length of the first panel 101. The perforation 101 is interrupted only by a semicircular die cut 130 which allows for holding of the first panel 101 at the die cut 130 by a user's thumb. FIG. 1A further shows a perforation 122 extending across the bottom edge and the entire length of the second panel 102. FIG. 1A further shows a perforation 123 extending across the top edge and the entire length of the third panel 103.

A die cut is a continuous or substantially continuous cut of a ply or sheet of paper. A perforation is a periodic series of small cuts or holes in a ply or sheet of paper. Various well-known form manufacturing processes can be used to form die cuts and perforations. In one embodiment, the fold lines 111, 112, 113 and 114 are perforations.

Note that the widths of the first panel 101, the second panel 102 and the third panel. 103 are congruent. The width of the fourth panel 104 is narrower than the widths of the first through third panels 101–103. The width of the fifth panel 105 is congruent with the width of the fourth panel 104. Also shown in FIG. 1A is a perforation 131 extending inside the left edge of the third panel 103 from perforation 123 to the bottom of the third panel 103. Note that perforation 131 is collinear with the left edges of fourth panel 104 and fifth panel 105. Further shown is a perforation 132 extending inside the right edge of the third panel 103 from perforation 123 to the bottom of the third panel 103. Note that perforation 132 is collinear with the right edges of fourth panel 104 and fifth panel 105. Lastly, shown in FIG. 1A is a perforation 155 extending inside the left edge of the fifth panel 105 from fold line 114 to the bottom of the fifth panel 105.

FIG. 1A shows variable printed information, including certified mail indicia 161, on first panel 101. The variable information printed on first panel 101 can include, among other things, a sender address, a recipient address, certified mail information, postage indicia and a Facing Identification Mark (FIM—a symbol on envelopes used for facilitating the sorting and routing of mail). Postage indicia include stamp postage, tape postage, PC postage and the like.

In an embodiment of the present invention, postage indicia and FIM are printed on first panel 101 near fold line 111. The U.S. Postal Service (USPS) requires that postage indicia and FIM be printed within ⅛ of an inch of the top edge of an envelope. The direction of printing in a sheet-feed printer is upwards. That is, a sheet enters the printer top-first and printing is performed from top to bottom. Typically, it is difficult, if not impossible, to program a sheet-fed printer to print data precisely near the top edge of paper, as the top edge is the first portion of the paper that is fed into the printer known as the gripper portion. If the postage indicia and FIM were located near the top of the first panel 101 (such as above the perforation 121), it would be problematic to print the postage indicia and FIM within ⅛ of an inch of the top edge of the first panel 101. Thus, the postage indicia and FIM are printed near the horizontal fold line 111, which is away from the edge of the sheet of the first panel 101. Typically, it is possible to program a sheet-fed printer to print data precisely in areas away from the edges of the paper.

Note that the variable information printed on first panel 101 can be printed in a downwards-facing or in an upwards facing orientation. The foregoing features of the present invention are advantageous as it allows the mailer to be printed in a typical sheet-fed non-impact printer. Additionally, it allows the postage indicia and FIM to be printed within ⅛ of an inch of the top edge of the mailer, as required by the USPS.

Figure 1B:
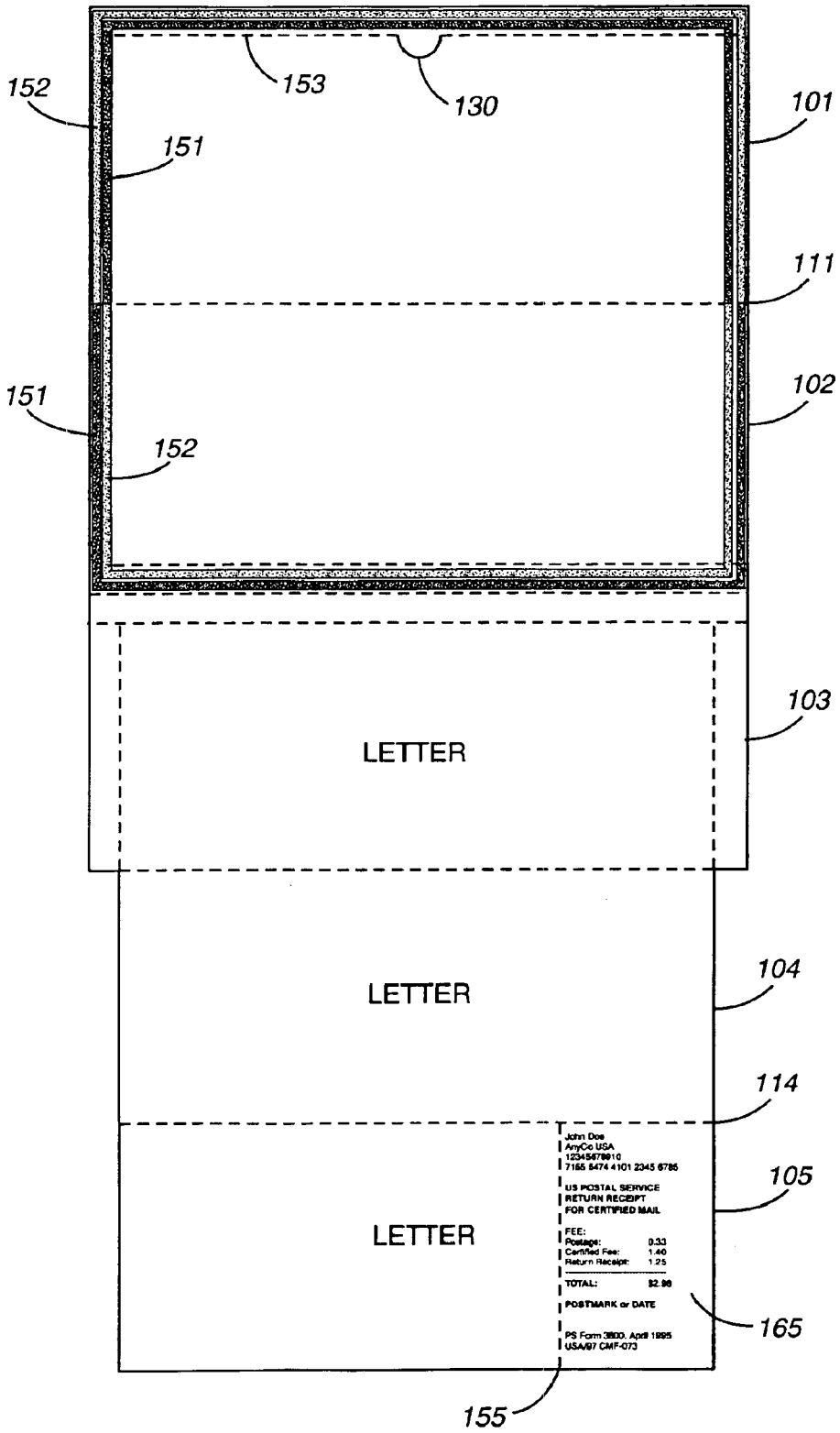
FIG. 1B shows a top view of the back of the mailing form of FIG. 1A.

FIG. 1B shows a top view of the back of the mailing form of FIG. 1A. FIG. 1B shows that a document, including the information associated with the document, can be printed on the third panel 103, the fourth panel 104 and the fifth panel 105. FIG. 1B also shows that information can be printed in the area 165 of the fifth panel 105 to the right of the perforation 155. In one embodiment, a certified mail receipt is printed onto the area 165 of the fifth panel 105 to the right of the perforation 155, allowing a user to tear along perforation 155 and fold line 114 to release the area 165 and retain it.

FIG. 1B further shows adhesive 152 applied to the right, upper and left inside edges of the first panel 101. Also shown is a releasable substrate 151, such as silicon, applied to the right, lower and left inside edges of the second panel 102. Note that the position of the releasable substrate 151 mirrors the position of the adhesive 152 on the first panel 101. Note that the releasable substrate 151 and the adhesive 152 are positioned such that when the first panel 101 is folded along the fold line 111 so that the back face of the first panel 101 contacts the back face of the second panel 102, the adhesive 152 contacts, and is laid on top of, the releasable substrate 151. In folded form, the mailer is held secure by the adhesive 152 and the releasable substrate 151. However, because of the releasable nature of the releasable substrate 151, the mailer can be easily unfolded along fold line 111.

FIG. 1B further shows an adhesive/releasable substrate combination 153 applied to the right, upper and left inside edges of the first panel 101, positioned further from the edges of the first panel 101 than the adhesive deposit 152. The adhesive/releasable substrate combination 153 consists of a layer of adhesive layered on top of a layer of releasable substrate. The adhesive/releasable substrate combination 153 is positioned such that when the first panel 101 is folded along the fold line 111 so that the back face of the first panel 101 contacts the back face of the second panel 102, the adhesive/releasable substrate combination 153 contacts, and is laid on top of, exposed paper areas of the second panel 102. Adhesive contacts and bonds with, or sticks to, paper.

In folded form, the mailer is held secure by the adhesive of the adhesive/releasable substrate combination 153 bonding with paper of the back of second panel 102. However, because of the releasable nature of the releasable substrate of the adhesive/releasable substrate combination 153, the mailer can be easily unfolded along fold line 111. When the mailer is unfolded along fold line 111, the adhesive of the adhesive/releasable substrate combination 153 remains on the paper of the second panel 102 while the releasable substrate of the adhesive/releasable substrate combination 153 remains on the first panel 101.

Figure 2A:
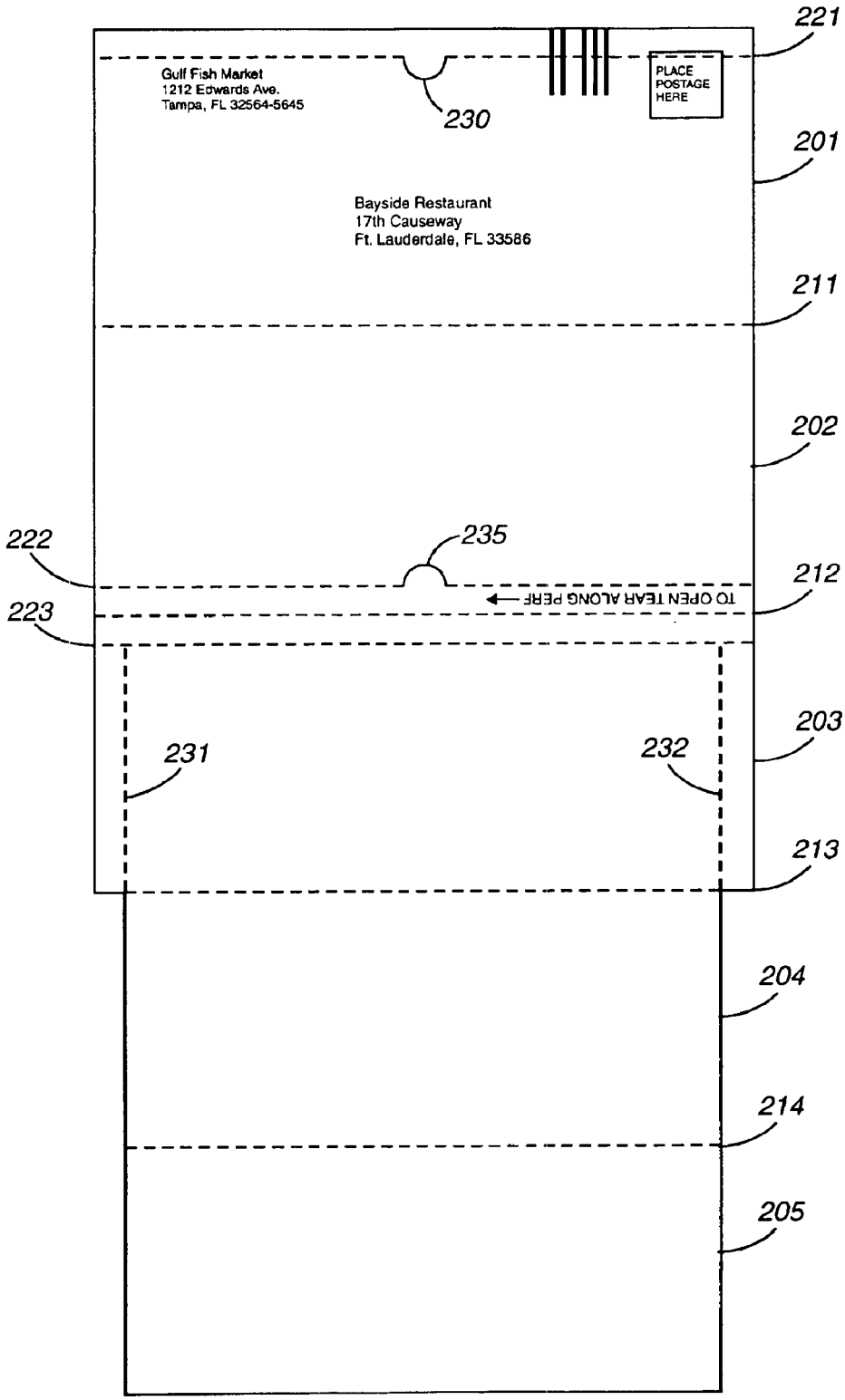
FIG. 2A shows a top view of the front of a five-panel mailing form including a tax form, in one embodiment of the present invention.

FIG. 2A shows a top view of the front of a five-panel mailing form including a tax form, in one embodiment of the present invention. FIG. 2A shows that the mailing form, or mailer, comprising a ply, which is a rectangular sheet of paper having dimensions and constitution similar to those of the mailer of FIG. 1A. Either side of the ply can receive printed information when passed through a simplex non-impact printer. FIG. 2A shows a first panel 201, a second panel 202, a third panel 203, a fourth panel 204 and a fifth panel 205, all of substantially the same area. Each panel is separated by a fold line, 211, 212, 213 and 214, respectively.

The mailer of FIG. 2A includes perforations and die cuts similar to those of the mailer of FIG. 1A, including perforations 221, 222, 223, 231, 232. FIG. 2A further shows semicircular die cut 230 interrupting perforation 221 and semicircular die cut 235 interrupting perforation 222. FIG. 2A further shows variable printed information on first panel 201. The variable information printed on first panel 201 can include, among other things, a sender address, a recipient address, certified mail information, postage indicia and a FIM. Note that the variable information printed on first panel 201 can be printed in a downwards-facing or in an upwards facing orientation.

Figure 2B:
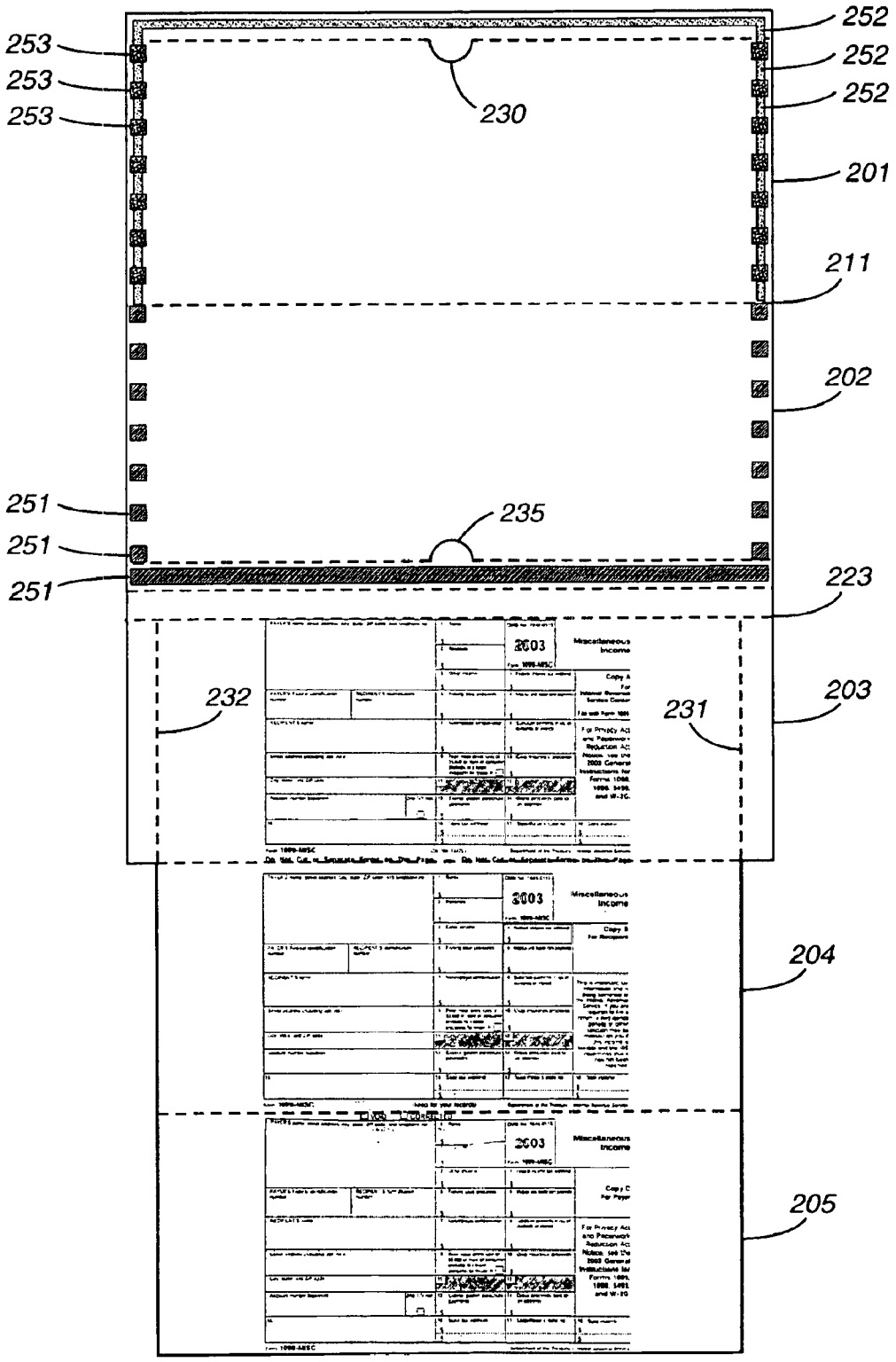
FIG. 2B shows a top view of the back of the mailing form of FIG. 2A.

FIG. 2B shows a top view of the back of the mailing form of FIG. 2A. FIG. 2B shows a top view of the back of the mailing form of FIG. 2A. FIG. 2B shows that a tax document, including the information associated with the tax document, can be printed on the third panel 203, the fourth panel 204 and the fifth panel 205. FIG. 2B also shows that the tax document is positioned in such a way that a user may tear along perforations 232, 231 and 223 to release the tax document and retain it.

FIG. 2B further shows adhesive 252 applied in a recurring pattern to the right and left inside edges of the first panel 201 and applied in a continuous line along the top inside edge of the first panel 201. Also shown is a releasable substrate 251, such as silicon, applied in a recurring pattern to the right and left inside edges of the second panel 202 and applied in a continuous line along the bottom inside edge of the second panel 202. Note that the position of the releasable substrate 251 mirrors the position of the adhesive 252 on the first panel 201. This is described in more detail with reference to FIG. 9. Note that the releasable substrate 251 and the adhesive 252 are positioned such that when the first panel 201 is folded along the fold line 211 so that the back face of the first panel 201 contacts the back face of the second panel 202, the adhesive 252 contacts, and is laid on top of, the releasable substrate 251. In folded form, the mailer is held secure by the adhesive 252 and the releasable substrate 251. However, because of the releasable nature of the releasable substrate 251, the mailer can be easily unfolded along fold line 211.

FIG. 2B further shows an adhesive/releasable substrate combination 253 applied in a recurring pattern to the right and left inside edges of the first panel 201, interlaced with the adhesive deposit 252. The adhesive/releasable substrate combination 253 consists of a layer of adhesive layered on top of a layer of releasable substrate. The adhesive/releasable substrate combination 253 is positioned such that when the first panel 201 is folded along the fold line 211 so that the back face of the first panel 201 contacts the back face of the second panel 202, the adhesive/releasable substrate combination 253 contacts, and is laid on top of, exposed paper areas of the second panel 202. Adhesive contacts and bonds with, or sticks to, paper.

In folded form, the mailer is held secure by the adhesive of the adhesive/releasable substrate combination 253 bonding with paper of the back of second panel 202. However, because of the releasable nature of the releasable substrate of the adhesive/releasable substrate combination 253, the mailer can be easily unfolded along fold line 211. When the mailer is unfolded along fold line 211, the adhesive of the adhesive/releasable substrate combination 253 remains on the paper of the second panel 202 while the releasable substrate of the adhesive/releasable substrate combination 253 remains on the first panel 201.

Figure 3A:
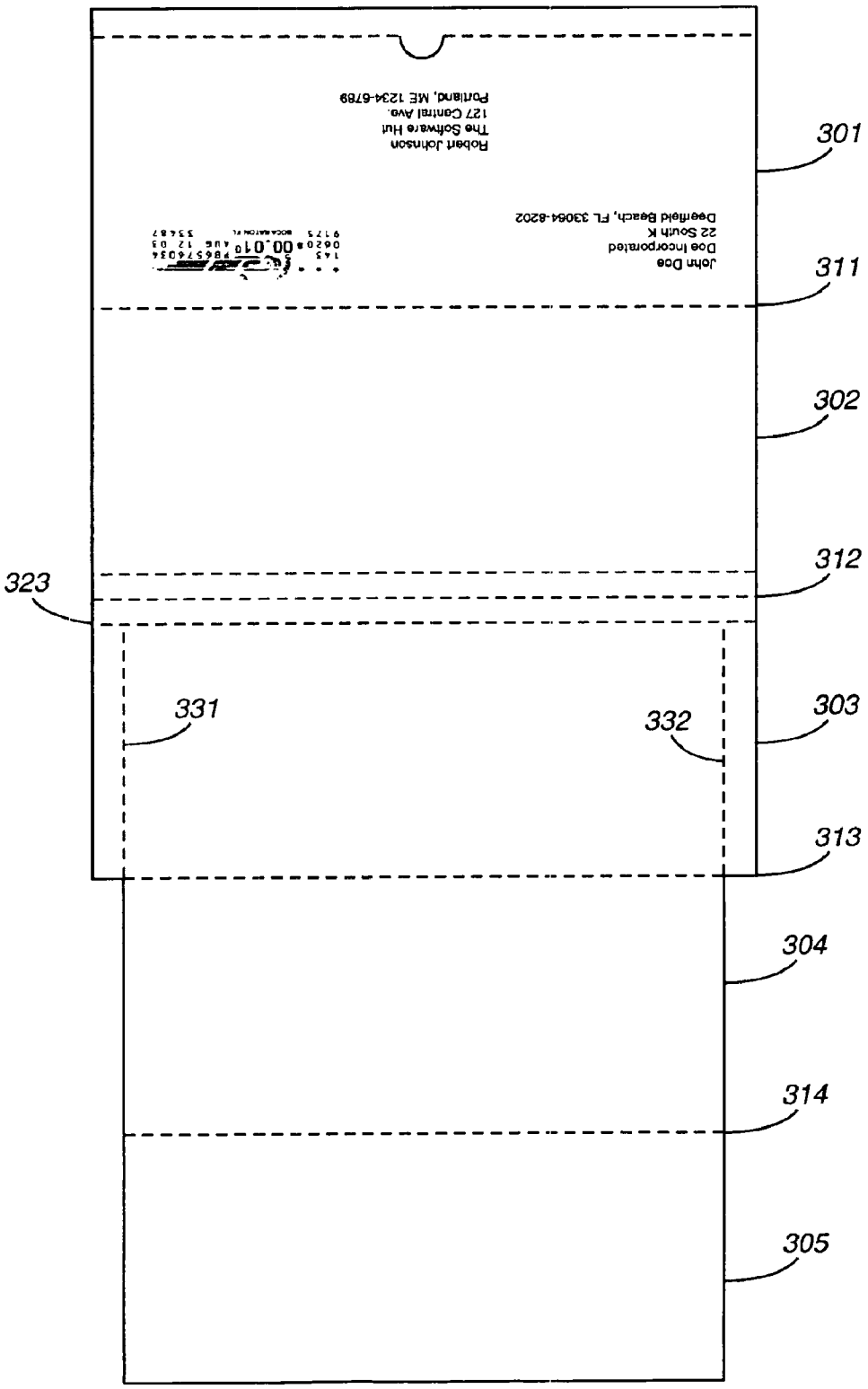
FIG. 3A shows a top view of the front of a five-panel mailing form including an invoice and a return envelope, in one embodiment of the present invention.

FIG. 3A shows a top view of the front of a five-panel mailing form including an invoice and a return envelope, in one embodiment of the present invention. FIG. 3A shows that the mailing form, or mailer, comprising a ply, which is a rectangular sheet of paper having dimensions and constitution similar to those of the mailer of FIG. 1A. Either side of the ply can receive printed information when passed through a simplex non-impact printer. FIG. 3A shows a first panel 301, a second panel 302, a third panel 303, a fourth panel 304 and a fifth panel 305, all of substantially the same area. A fold line, 311, 312, 313 and 314, separates each panel respectively.

The mailer of FIG. 3A includes perforations and die cuts similar to those of the mailer of FIG. 1A, including perforations 331, 332 and 323. FIG. 3A further shows variable printed information on first panel 301. The variable information printed on first panel 301 can include, among other things, a sender address, a recipient address, certified mail information, postage indicia and a FIM. Note that the variable information printed on first panel 301 can be printed in a downwards-facing or in an upwards facing orientation.

Figure 3B:
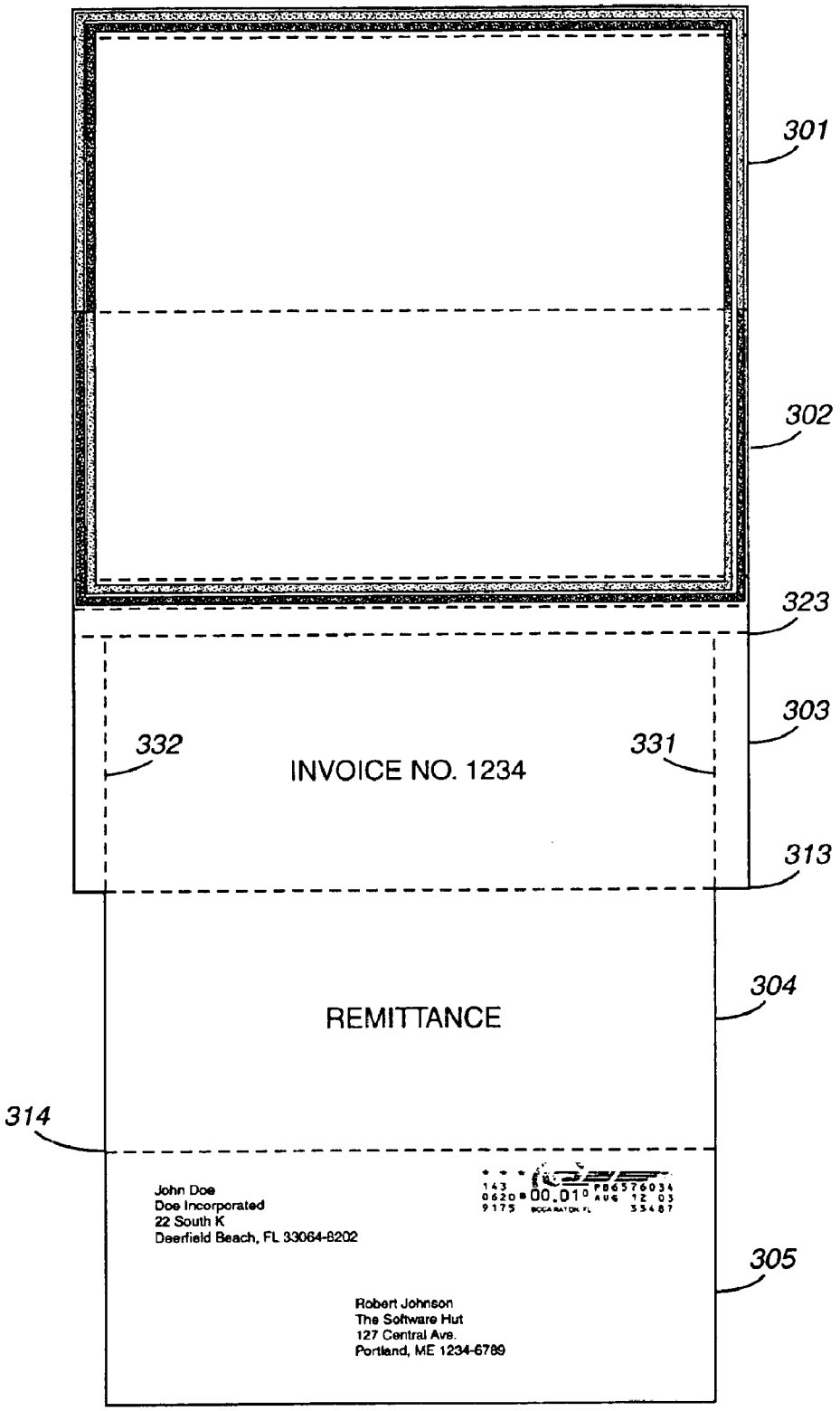
FIG. 3B shows a top view of the back of the mailing form of FIG. 3A.

FIG. 3B shows a top view of the back of the mailing form of FIG. 3A. FIG. 3B shows that information can be printed on the third panel 303, the fourth panel 304 and the fifth panel 305. Specifically, an invoice is printed onto third panel 303, a remittance is printed onto fourth panel 304 and a return envelope is printed onto the face of the fifth panel 305. FIG. 3B also shows that the invoice and remittance are positioned in such a way that a user may tear along perforations 332, 331 and 323 and along fold line 313 to release the invoice and retain it. Further, a user may tear along fold line 314 to release the remittance and the return envelope 305. Additionally, the mailer of FIG. 3B includes adhesive, releasable substrate and an adhesive/releasable substrate combination similar to that described with reference to FIG. 1B.

Figure 4A:
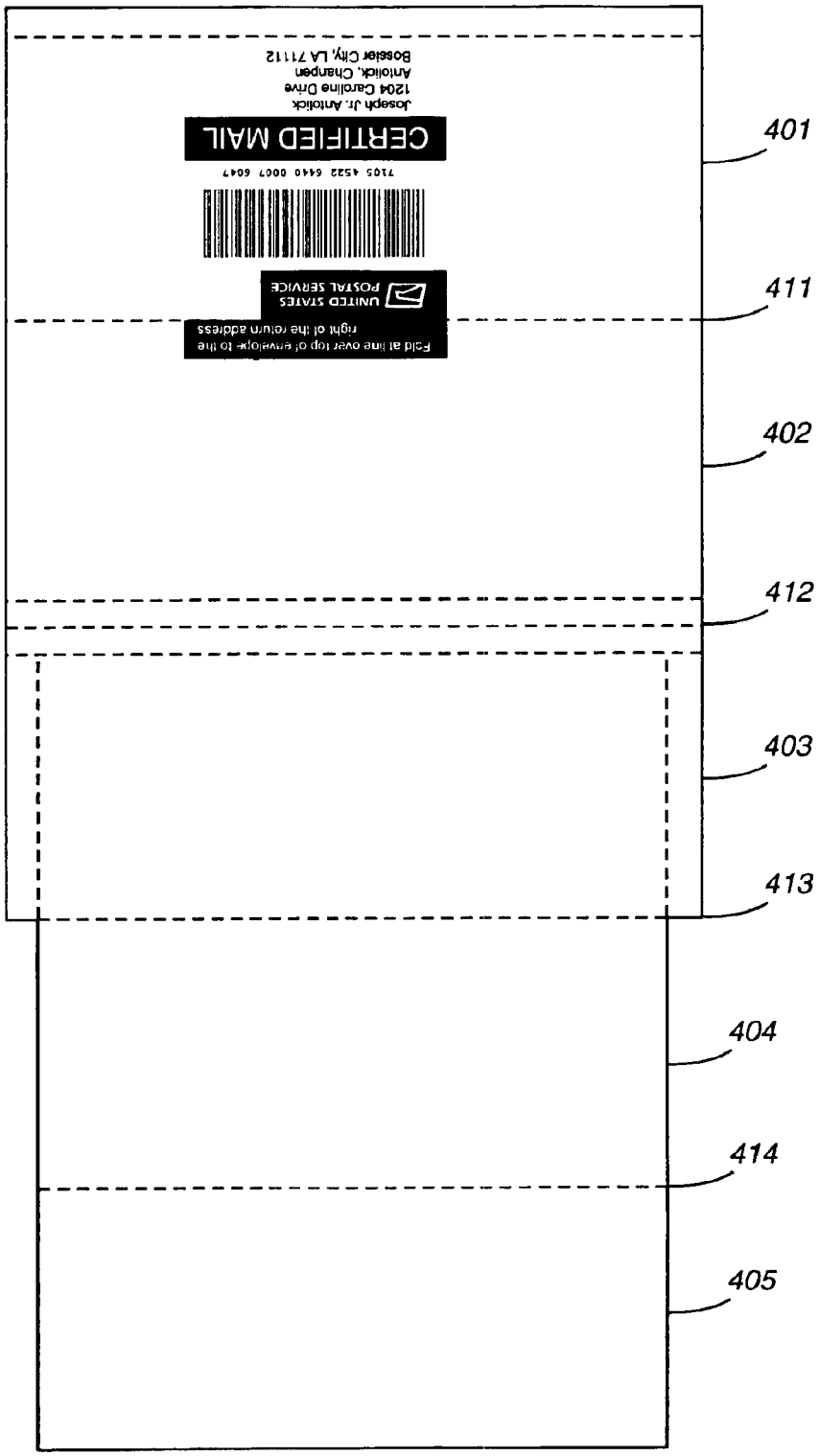
FIG. 4A shows a top view of the front of a five-panel certified mailing form including a letter and instructions, in one embodiment of the present invention.

FIG. 4A shows a top view of the front of a five-panel certified mailing form including a letter and instructions, in one embodiment of the present invention. FIG. 4A shows that the mailing form, or mailer, comprising a ply, which is a rectangular sheet of paper having dimensions and constitution similar to those of the mailer of FIG. 1A. Either side of the ply can receive printed information when passed through a simplex non-impact printer. FIG. 4A shows a first panel 401, a second panel 402, a third panel 403, a fourth panel 404 and a fifth panel 405, all of substantially the same area. A fold line, 411, 412, 413 and 414 separates each panel, respectively.

The mailer of FIG. 4A includes perforations and die cuts similar to those of the mailer of FIG. 1A. FIG. 4A further shows variable printed information on first panel 401. The variable information printed on first panel 401 can include, among other things, a sender address, a recipient address, certified mail information, postage indicia and a FIM. Note that the variable information printed on first panel 401 can be printed in a downwards-facing or in an upwards facing orientation.

Figure 4B:
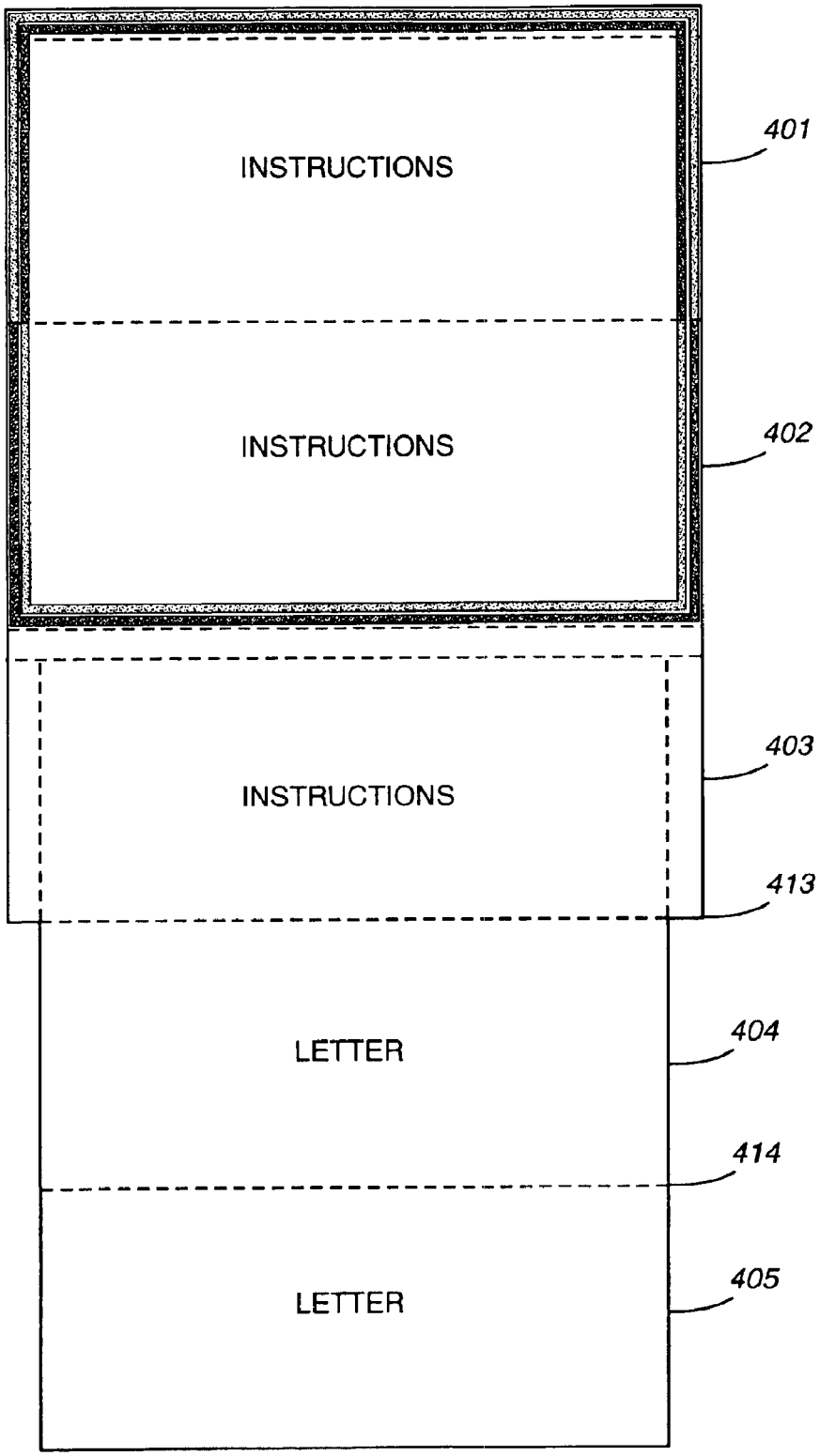
FIG. 4B shows a top view of the back of the mailing form of FIG. 4A.

FIG. 4B shows a top view of the back of the mailing form of FIG. 4A. FIG. 4B shows that information can be printed on all five panels 401-405. Specifically, instructions are printed onto the first through third panels 401-403 and letter information is printed onto the fourth through fifth panels 404-405. FIG. 4B also shows that the letter information is positioned in such a way that a user may tear along fold lines 413 and/or 414 to release the letter and retain it. Additionally, the mailer of FIG. 4B includes adhesive, releasable substrate and an adhesive/releasable substrate combination similar to that described with reference to FIG. 1B.

Figure 5A:
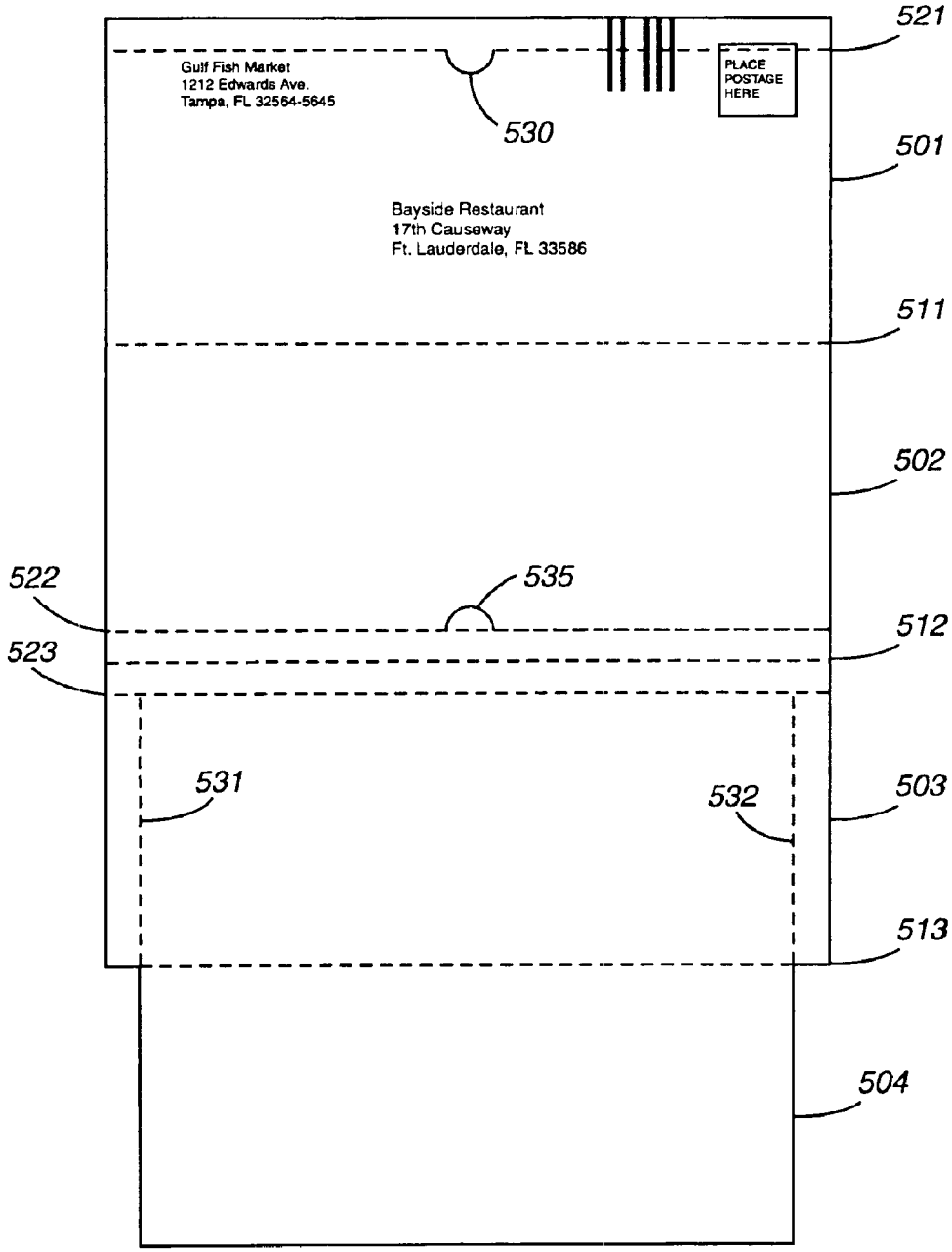
FIG. 5A shows a top view of the front of a four-panel mailing form including a check and a check receipt, in one embodiment of the present invention.

FIG. 5A shows a top view of the front of a four-panel mailing form including a check and a check receipt, in one embodiment of the present invention. FIG. 5A shows that the mailing form, or mailer, comprises a ply, which is a rectangular sheet of paper having dimensions and constitution similar to those of the mailer of FIG. 1A. Either side of the ply can receive printed information when passed through a simplex non-impact printer.

FIG. 5A shows a first panel 501, a second panel 502, a third panel 503 and a fourth panel 504, all of substantially the same area. A fold line separates each panel. The first panel 501 and the second panel 502 are separated by a fold line 511, the second panel 502 and the third panel 503 are separated by a fold line 512 and the third panel 503 and the fourth panel 504 are separated by a fold line 513.

The mailer of FIG. 5A includes perforations and die cuts similar to those of the mailer of FIG. 1A, including perforations 521, 522, 531, 532 and 523 and die cuts 530 and 535. FIG. 5A further shows variable printed information on first panel 501. The variable information printed on first panel 501 can include, among other things, a sender address, a recipient address, certified mail information, postage indicia and a FIM. Note that the variable information printed on first panel 501 can be printed in a downwards-facing or in an upwards facing orientation.

Figure 5B:
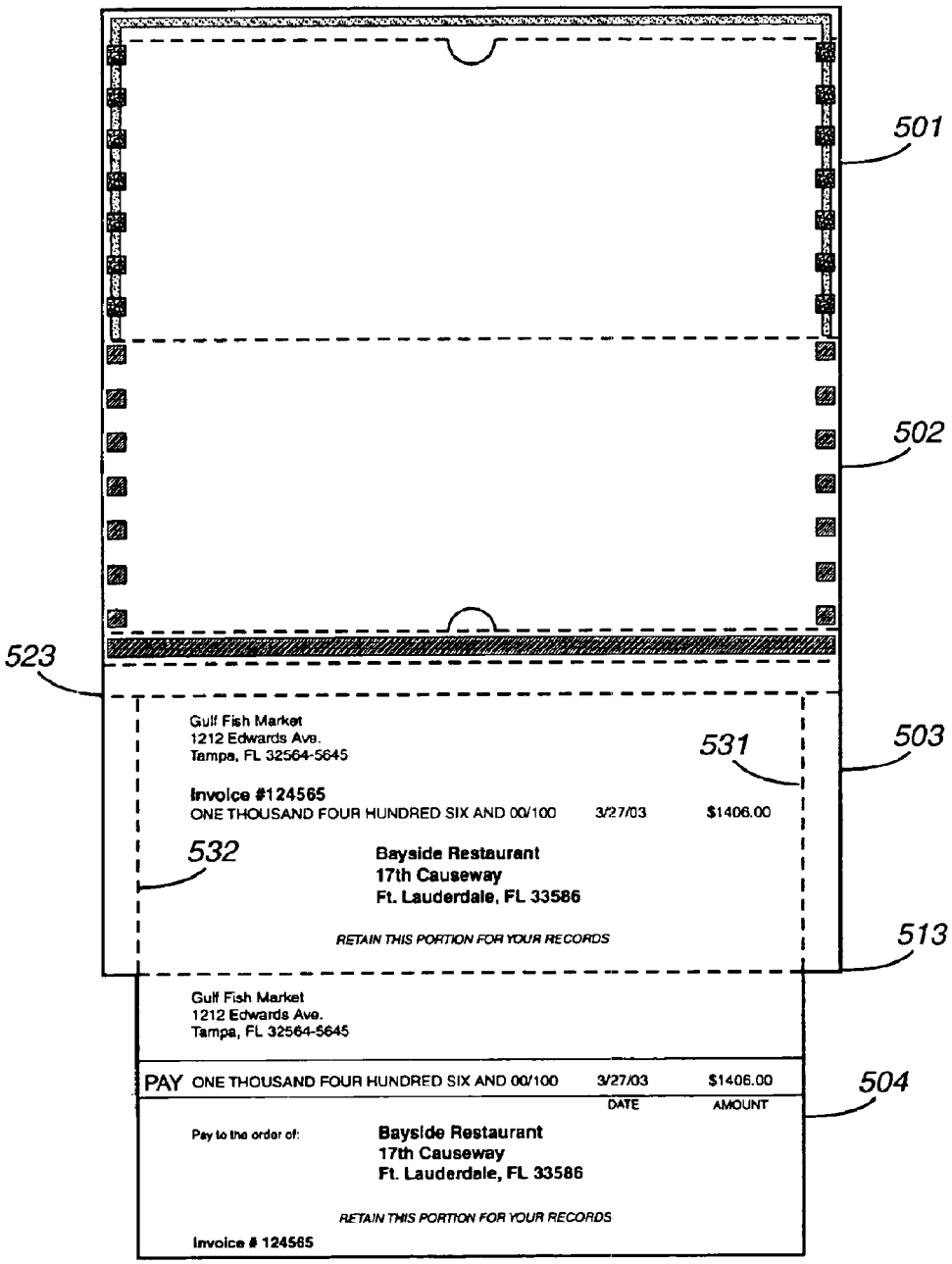
FIG. 5B shows a top view of the back of the mailing form of FIG. 5A.

FIG. 5B shows a top view of the back of the mailing form of FIG. 5A. FIG. 5B shows that information can be printed on the third panel 503 and the fourth panel 504. Specifically, an invoice or receipt is printed onto third panel 503, and a check is printed onto fourth panel 504. FIG. 5B also shows that the invoice and check are positioned in such a way that a user may tear along perforations 532, 531 and 523 and along fold line 513 to release the invoice and check and retain it. Additionally, the mailer of FIG. 5B includes adhesive, releasable substrate and an adhesive/releasable substrate combination similar to that described with reference to FIG. 2B.

Figure 6A:
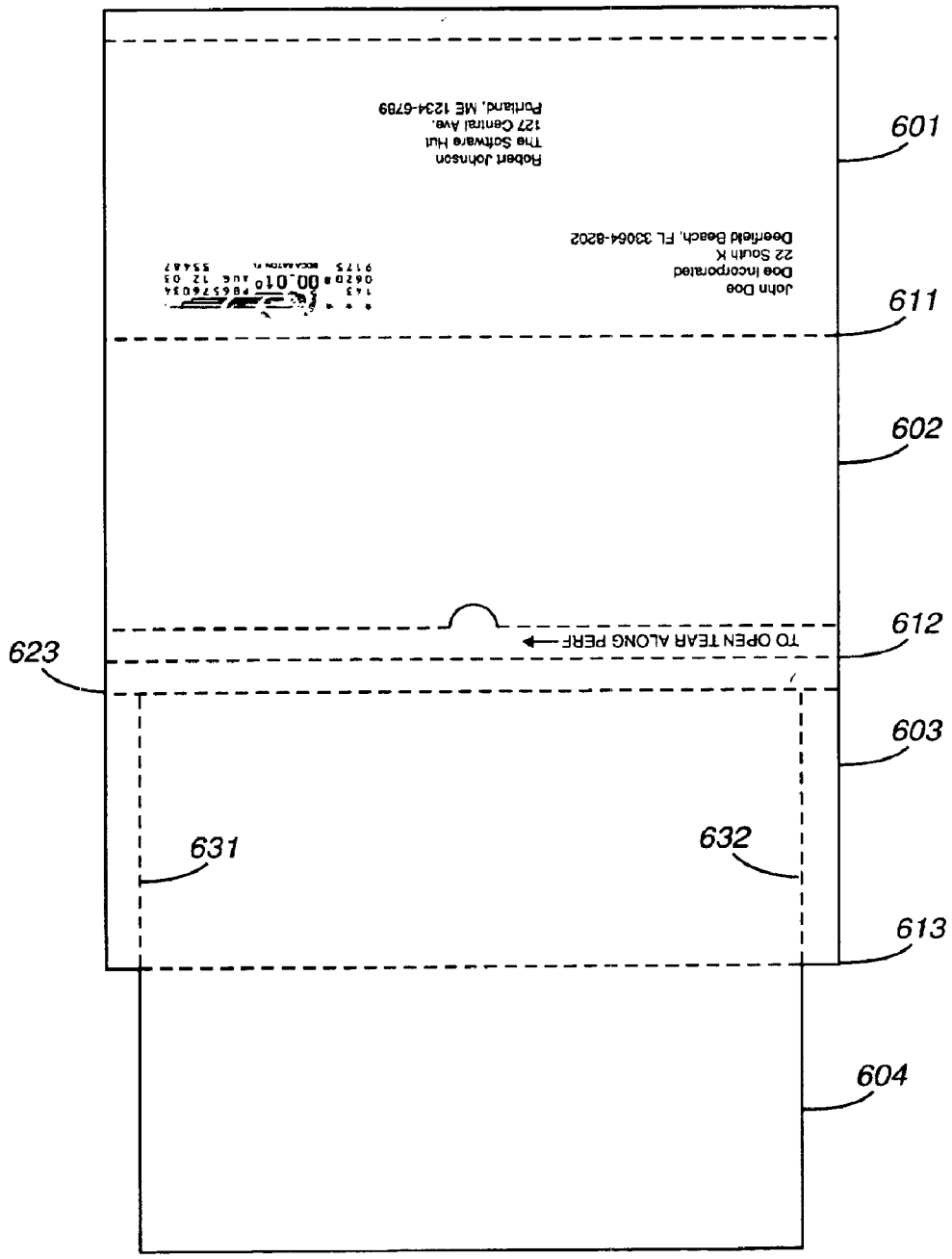
FIG. 6A shows a top view of the front of a four-panel mailing form including a document, in one embodiment of the present invention.

FIG. 6A shows a top view of the front of a four-panel mailing form including a document, in one embodiment of the present invention. FIG. 6A shows that the mailing form, or mailer, comprises a ply, which is a rectangular sheet of paper having dimensions and constitution similar to those of the mailer of FIG. 5A. Either side of the ply can receive printed information when passed through a simplex non-impact printer. FIG. 6A shows a first panel 601, a second panel 602, a third panel 603 and a fourth panel 604, all of substantially the same area and each panel separated by a fold line 611, 612, and 613, respectively.

The mailer of FIG. 6A includes perforations and die cuts similar to those of the mailer of FIG. 5A, including perforations 631, 632 and 623. FIG. 6A further shows variable printed information on first panel 601. The variable information printed on first panel 601 can include, among other things, a sender address, a recipient address, certified mail information, postage indicia and a FIM. Note that the variable information printed on first panel 601 can be printed in a downwards-facing or in an upwards facing orientation.

Figure 6B:
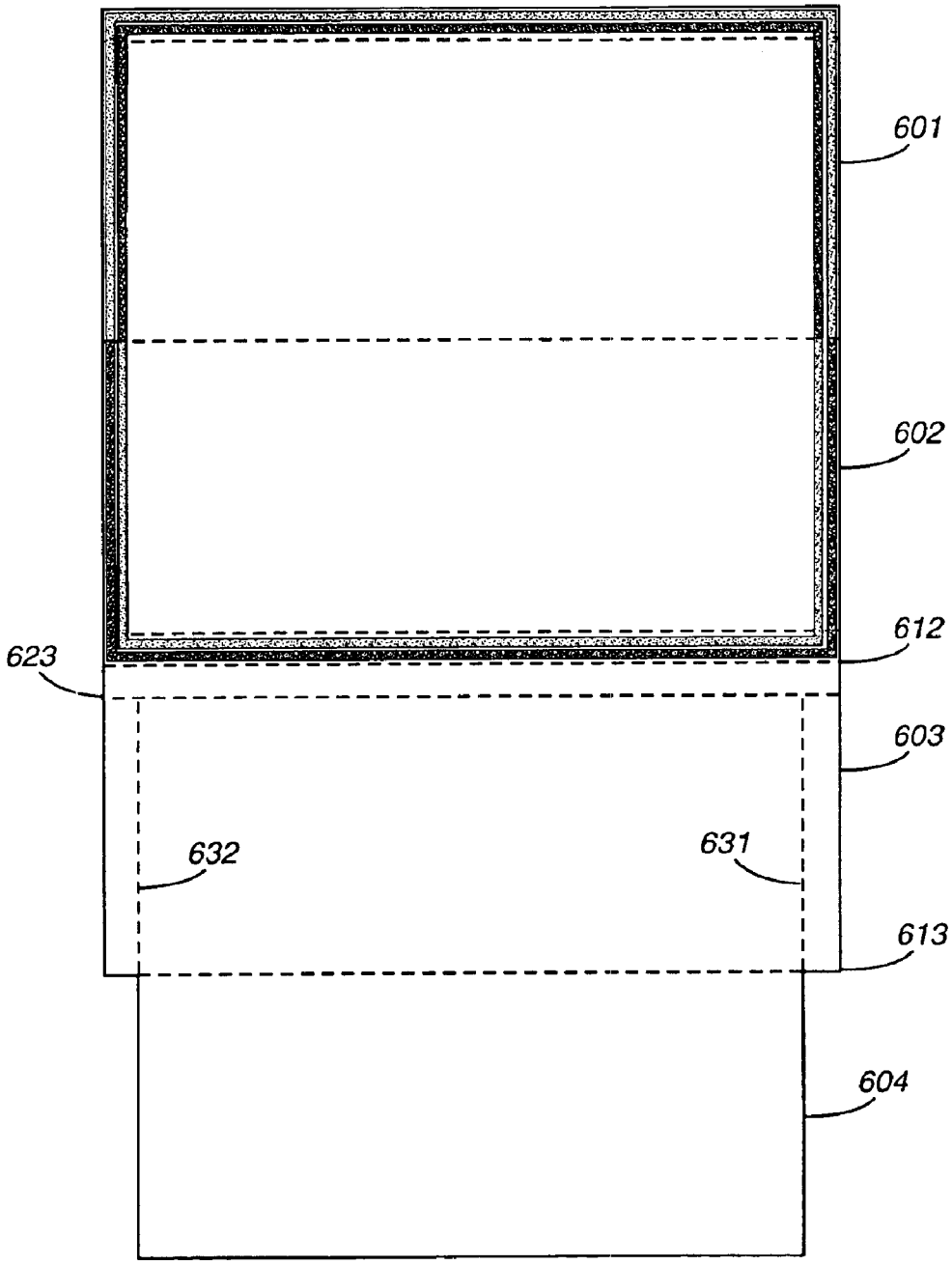
FIG. 6B shows a top view of the back of the mailing form of FIG. 6A.

FIG. 6B shows a top view of the back of the mailing form of FIG. 6A. FIG. 6B shows that information can be printed on the third panel 603 and the fourth panel 604. FIG. 6B also shows that the third panel 603 and the fourth panel 604 are positioned in such a way that a user may tear along perforations 632, 631 and 623 and along fold line 613 to release the third panel 603 and the fourth panel 604 and retain them. Additionally, the mailer of FIG. 6B includes adhesive, releasable substrate and an adhesive/releasable substrate combination similar to that described with reference to FIG. 1B.

Figure 7A:
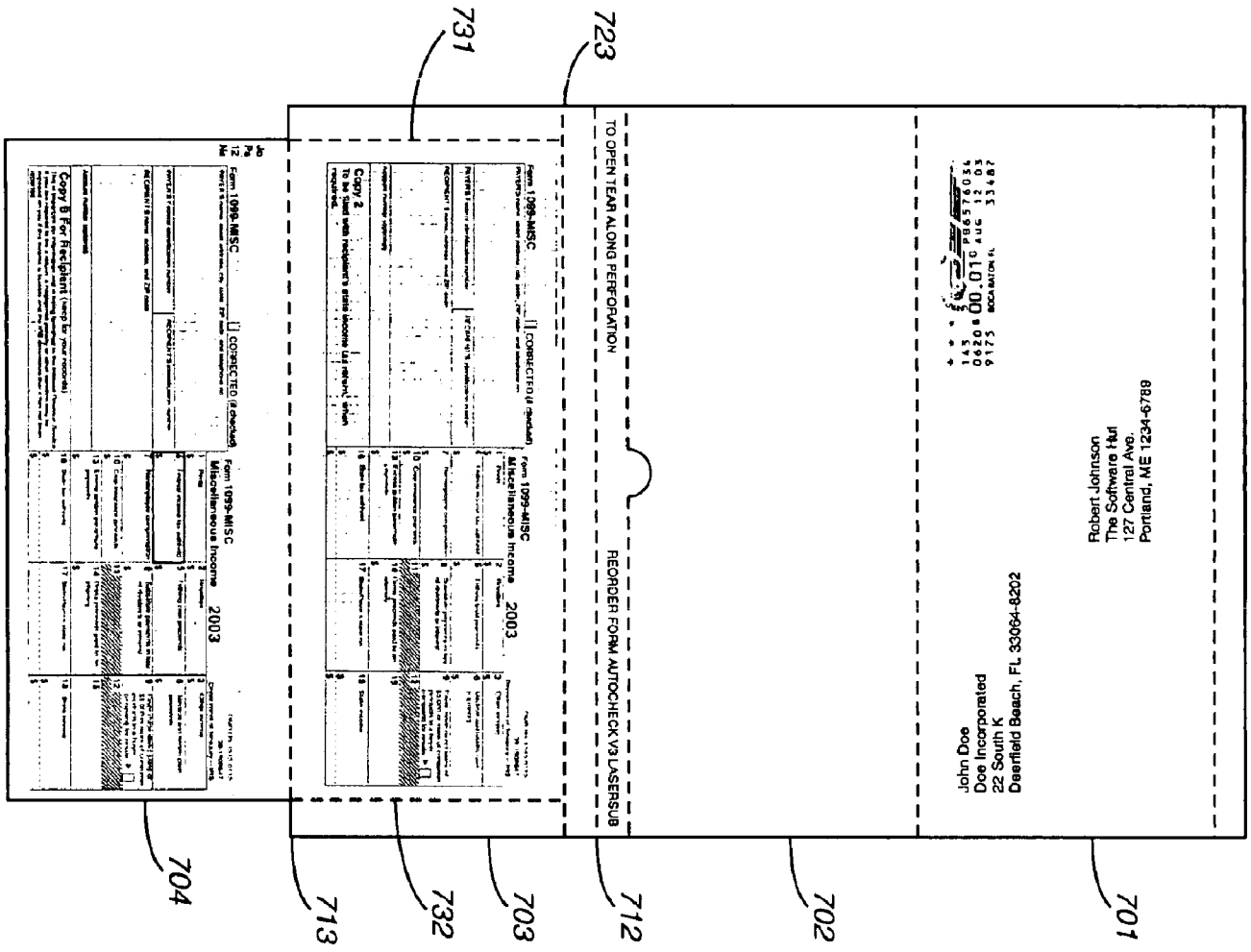
FIG. 7A shows a top view of the front of a four-panel mailing form including a tax form, in one embodiment of the present invention.

FIG. 7A shows a top view of the front of a four-panel mailing form including a tax form, in one embodiment of the present invention. FIG. 7A shows that the mailing form, or mailer, comprises a ply, which is a rectangular sheet of paper having dimensions and constitution similar to those of the mailer of FIG. 5A. Either side of the ply can receive printed information when passed through a simplex non-impact printer. FIG. 7A shows a first panel 701, a second panel 702, a third panel 703 and a fourth panel 704, all of substantially the same area and each panel separated by a fold line 711, 712, and 713, respectively.

The mailer of FIG. 7A includes perforations and die cuts similar to those of the mailer of FIG. 5A, including perforations 731, 732 and 723. FIG. 7A further shows variable printed information on first panel 701. The variable information printed on first panel 701 can include, among other things, a sender address, a recipient address, certified mail information, postage indicia and a FIM. Note that the variable information printed on first panel 701 can be printed in a downwards-facing or in an upwards facing orientation.

FIG. 7A shows that information can be printed on the third panel 703 and the fourth panel 704. Specifically, a tax form is printed onto third panel 703 and fourth panel 704. FIG. 7A also shows that the two tax forms are positioned in such a way that a user may tear along perforations 732, 731 and 723 and along fold line 713 to release the two tax forms (in third panel 703 and the fourth panel 704, respectively) and retain them.

Figure 7B:
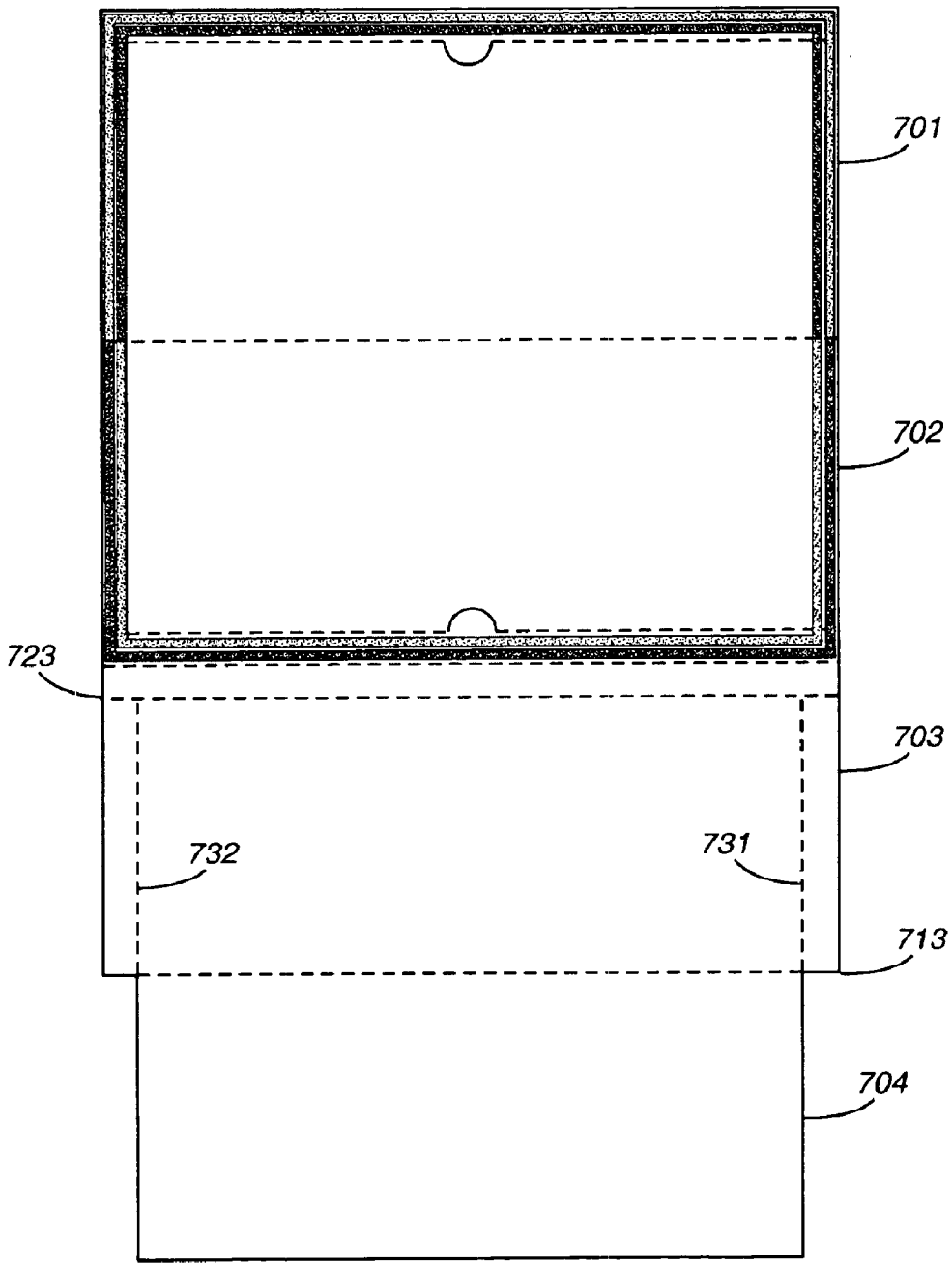
FIG. 7B shows a top view of the back of the mailing form of FIG. 7A.

FIG. 7B shows a top view of the back of the mailing form of FIG. 7A. The mailer of FIG. 7B includes adhesive, releasable substrate and an adhesive/releasable substrate combination similar to that described with reference to FIG. 1B.

Figure 8:
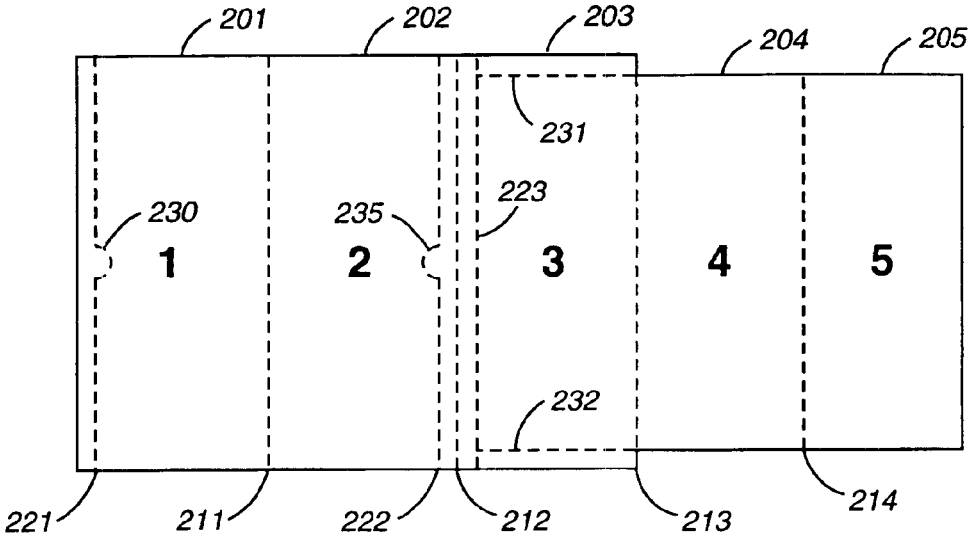
FIG. 8 shows a top view of the back of a general five-panel mailing form, in one embodiment of the present invention.

FIG. 8 shows a top view of the back of a general five-panel mailing form, in one embodiment of the present invention. The mailing form of FIG. 2A and FIG. 2B is used as an example in FIG. 8. FIG. 8 shows a first panel 201, a second panel 202, a third panel 203, a fourth panel 204 and a fifth panel 205, all of substantially the same area. A fold line, 211, 212, 213 and 214 separates each panel, respectively. The mailer of FIG. 8 includes perforations and die cuts similar to those of the mailer of FIG. 1A.

Figure 10:
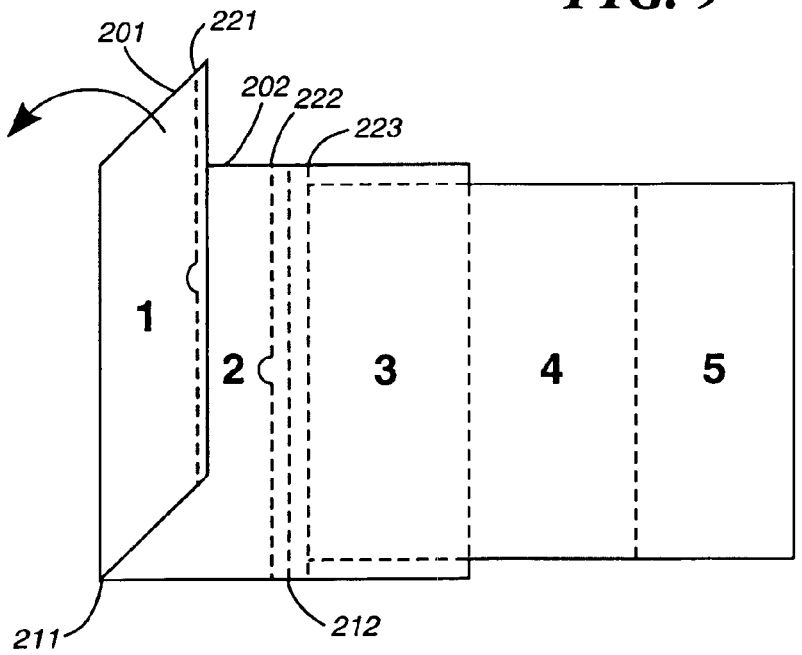
FIG. 10 shows an angled view of the back of the mailing form of FIG. 8 during the first step of the folding process.

FIG. 10 shows an angled view of the back of the mailing form of FIG. 8 during the first step of the folding process. FIG. 10 shows that the first panel 201 is folded along the fold line 211 such that the back face of the first panel 201 contacts the back face of the second panel 202. This folding configuration allows information to be printed onto the front face of the first panel 201, the back face of the third panel 203, the back face of the fourth panel 204 and the back face of the fifth panel 205. This is advantageous as it allows all of the necessary information for a mailer to be printed in a single pass by a single pass simplex non-impact printer.

The mailer of FIG. 10 includes adhesive, releasable substrate and an adhesive/releasable substrate combination similar to that described with reference to FIG. 2B (although not shown in FIG. 10). The mailer of FIG. 10 is first folded along fold line 211 as described above. The result of this action is that the back face of the first panel 201 contacts the back face of the second panel 202, the adhesive 252 contacts, and is laid on top of, the releasable substrate 251. In folded form, the mailer is held secure by the adhesive 252 and the releasable substrate 251. This temporary seal is important to prevent buckling or opening during the single pass print process. Many laser printers include a plate, a gripper wheel, jam screws or other apparatus to prevent mis-feeds of multiple sheets being stuck together, and this apparatus often cause folded paper to buckle. The temporary seal eliminates this buckling problem. A further result of the above action is that the adhesive/releasable substrate combination 253 contacts, and is laid on top of, exposed paper areas of the second panel 202. Adhesive contacts and bonds with, or sticks to, paper. In folded form, the mailer is held secure by the adhesive of the adhesive/releasable substrate combination 253 bonding with paper of the back of second panel 202.

Subsequently, information is printed on the relevant portions of the mailer of FIG. 10. However, because of the releasable nature of the releasable substrate 251 (and in 253), the mailer can be easily unfolded along fold line 211. When the mailer is unfolded along fold line 211, the adhesive of the adhesive/releasable substrate combination 253 remains on the paper of the second panel 202 while the releasable substrate of the adhesive/releasable substrate combination 253 remains on the first panel 201.

Figure 11:
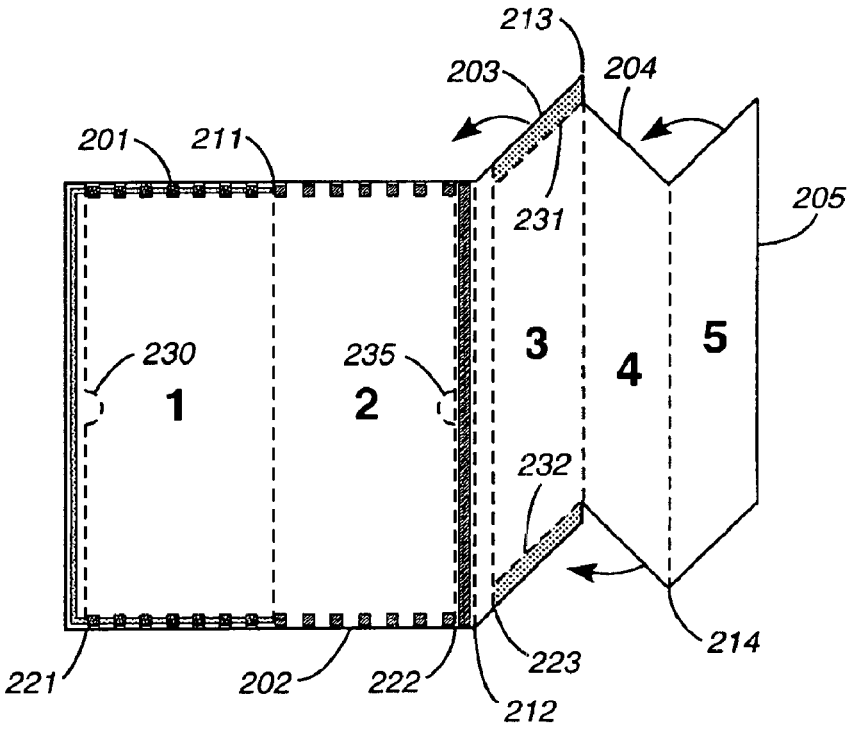
FIG. 11 shows an angled view of the back of the mailing form of FIG. 8 during the second step of the folding process.

FIG. 11 shows an angled view of the back of the mailing form of FIG. 8 during the second step of the folding process. The next step in the folding process includes folding the fifth panel 205 along the fold line 214 such that the back face of the fourth panel 204 contacts the back face of the fifth panel 205, folding the fourth panel 204 along the fold line 213 such that the front face of the fourth panel 204 contacts the front face of the third panel 203 and folding the third panel 203 along the fold line 212 such that the back face of the third panel 203 contacts the back face of the second panel 202. When the back face of the third panel 203 contacts the back face of the second panel 202, the adhesive deposited onto the back face of the second panel 202 contacts and bonds with the paper of the back face of the third panel 203. Specifically, the adhesive along the edges of the second panel 202 adheres to the area of the third panel 203 bounded by the perforations 231, 232 and the edges of the third panel 203. In this manner, the mailer of FIG. 11 is secured in folded form.

Figure 12:
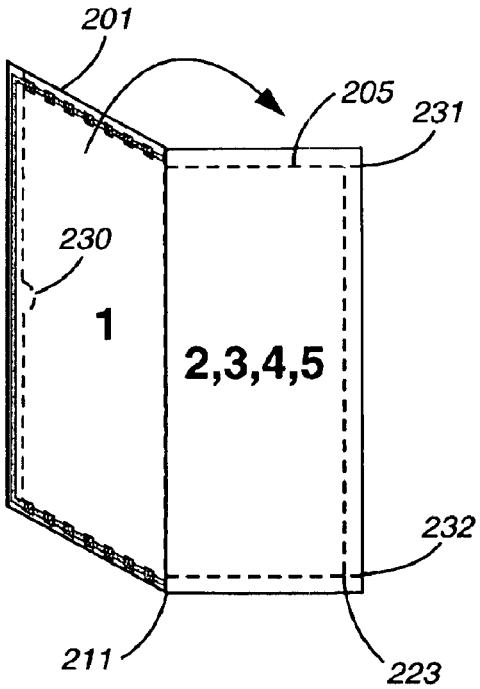
FIG. 12 shows an angled view of the back of the mailing form of FIG. 8 during the final step of the folding process.

FIG. 12 shows an angled view of the back of the mailing form of FIG. 8 during the final step of the folding process. FIG. 12 also shows the result of the folding steps described in FIG. 11. Note that in FIG. 12, the perforations 222 and 223 are aligned. Also note that fold line 214 is aligned with the fold line 212. Further note that the sides of the fourth panel 204 and the fifth panel 205 are aligned with the perforations 231 and 232. Thus, the right panel of the illustration of FIG. 12 shows the front face of the fifth panel 205 and the outer edges of the front face of the third panel 203.

Returning to the folding process, the next step in the folding process includes folding the first panel 201 along the fold line 211 such that the back face of the first panel 201 contacts the back face of the third panel 203. When the back face of the first panel 201 contacts the back face of the third panel 203, the adhesive deposited onto the back face of the first panel 201 contacts and bonds with the paper of the back face of the third panel 203. Specifically, the adhesive along the edges of the second panel 202 adheres to the outer edges of the back face of the third panel 203. In this manner, the mailer of FIG. 12 is secured in folded form. Accordingly, the third panel 203 acts as a barrier and/or inhibitor between the silicon and the glue permanently sealing the envelope.

Figure 13:
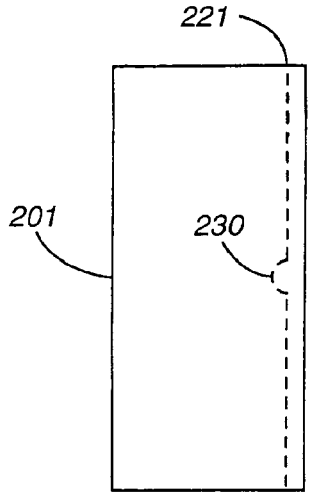
FIG. 13 shows a top view of the mailing form of FIG. 8 in fully folded form.

FIG. 13 shows a top view of the mailing form of FIG. 8 in fully folded form, wherein the mailing form is prepared for mailing. FIG. 13 also shows the result of the folding steps described in FIG. 12. Note that in FIG. 13, the perforations 221, 222 and 223 are aligned. Also note that the die cuts 230 and 235 are aligned. FIG. 13 shows the front face of the first panel 201.

Figure 14:
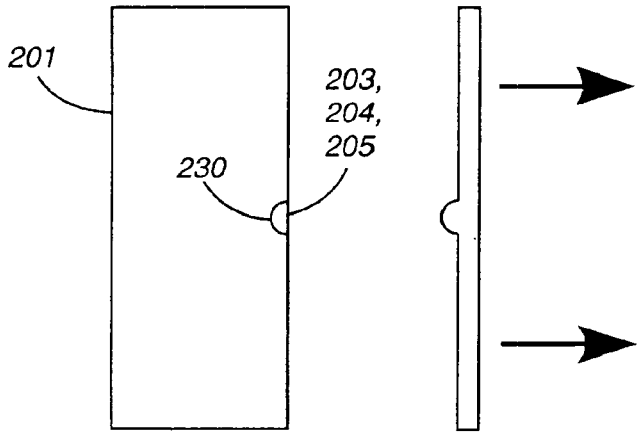
FIG. 14 shows a top view of the mailing form of FIG. 8 in fully folded form, during the first step of the document extraction process.

FIG. 14 shows a top view of the mailing form of FIG. 8 in fully folded form, during the first step of the document extraction process. FIG. 14 shows the tearing of the perforations 221, 222 and 223, which are aligned, and the exposing of the documents inside the mailer, i.e., the third through fifth panels 203–205. Note that the third through fifth panels 203–205 are exposed through the semicircular areas remaining from removal of die cuts 230 and 235.

Figure 15:
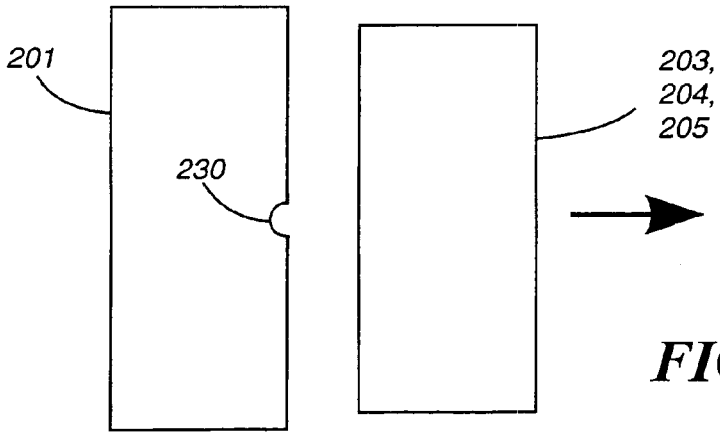
FIG. 15 shows a top view of the mailing form of FIG. 8 in fully folded form, during the final step of the document extraction process.

FIG. 15 shows a top view of the mailing form of FIG. 8 in fully folded form, during the final step of the document extraction process. In this step, a recipient pulls on the third through fifth panels 203–205, specifically on the area of those panels that are exposed through the semicircular areas remaining from removal of die cuts 230 and 235. Upon pulling by the recipient, the third through fifth panels 203–205 are released as the perforations 231, 232 and 223 are broken. This allows the recipient to extract the document.

Figure 16:
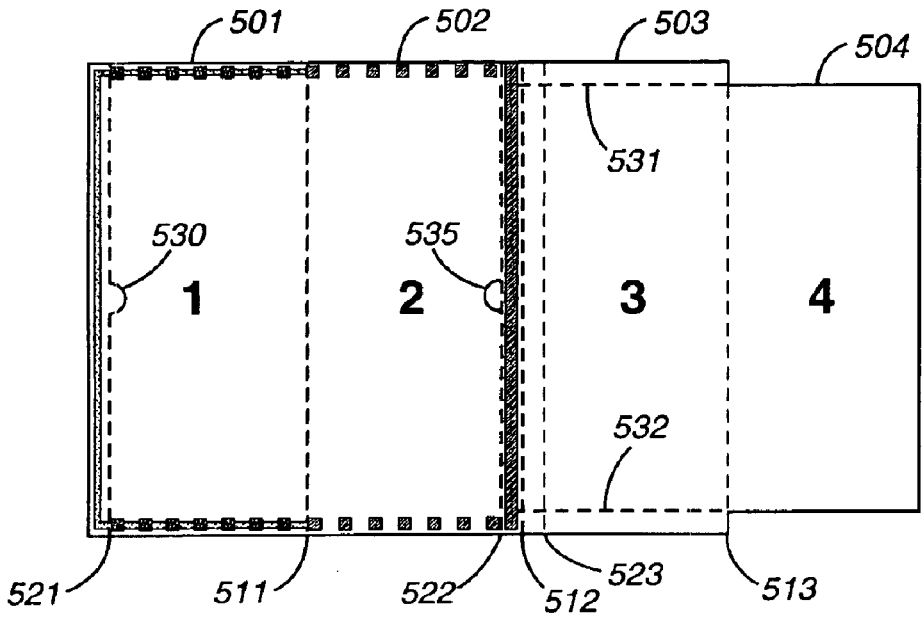
FIG. 16 shows a top view of the back of a general four-panel mailing form, in one embodiment of the present invention.

FIG. 16 shows a top view of the back of a general four-panel mailing form, in one embodiment of the present invention. The mailing form of FIG. 5A and FIG. 5B is used as an example in FIG. 16. FIG. 16 shows a first panel 501, a second panel 502, a third panel 503 and a fourth panel 504, all of substantially the same area. A fold line, 511, 512, 513 and 514, separates each panel respectively. The mailer of FIG. 16 includes perforations and die cuts similar to those of the mailer of FIG. 5A.

Figure 17:
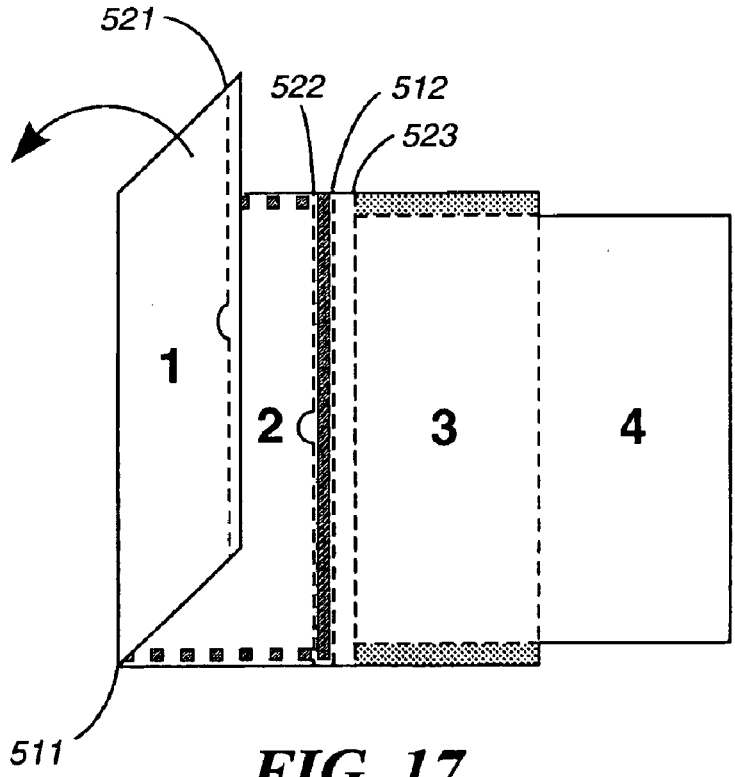
FIG. 17 shows an angled view of the back of the mailing form of FIG. 16 during the first step of the folding process.

FIG. 17 shows an angled view of the back of the mailing form of FIG. 16 during the first step of the folding process. FIG. 17 shows that the first panel 501 is folded along the fold line 511 such that the back face of the first panel 501 contacts the back face of the second panel 502. This folding configuration allows information to be printed onto the front face of the first panel 501, the back face of the third panel 203 and the back face of the fourth panel 504. This is advantageous as it allows all of the necessary information for a mailer to be printed in a single pass by a single pass simplex non-impact printer.

Figure 9:
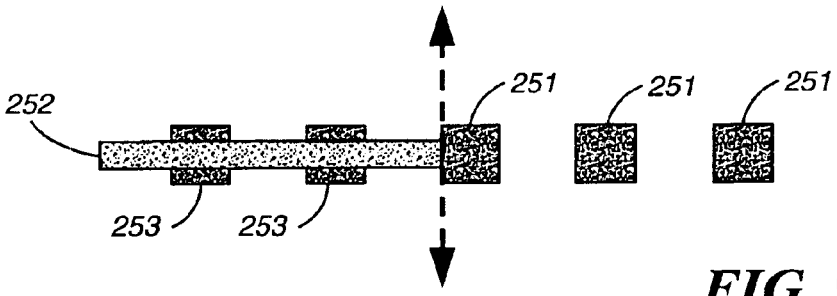
FIG. 9 is an illustration of adhesive and releasable substrate deposits, in one embodiment of the present invention.

The mailer of FIG. 16 includes adhesive, releasable substrate and an adhesive/releasable substrate combination similar to that described with reference to FIG. 5B and FIG. 9 above. The mailer of FIG. 16 is first folded along fold line 511 as described above. The result of this action is that the back face of the first panel 501 contacts the back face of the second panel 502, the adhesive 252 (see FIG. 9) contacts, and is laid on top of, the releasable substrate 251. In folded form, the mailer is held secure by the adhesive 252 and the releasable substrate 251. A further result of the above action is that the adhesive/releasable substrate combination 253 contacts, and is laid on top of, exposed paper areas of the second panel 502. Adhesive contacts and bonds with, or sticks to, paper. In folded form, the mailer is held secure by the adhesive of the adhesive/releasable substrate combination 253 bonding with paper of the back of second panel 502.

Subsequently, information is printed on the relevant portions of the mailer of FIG. 16. However, because of the releasable nature of the releasable substrate 251 (and in 253), the mailer can be easily unfolded along fold line 511. When the mailer is unfolded along fold line 511, the adhesive of the adhesive/releasable substrate combination 253 remains on the paper of the second panel 502 while the releasable substrate of the adhesive/releasable substrate combination 253 remains on the first panel 501.

Figure 18:
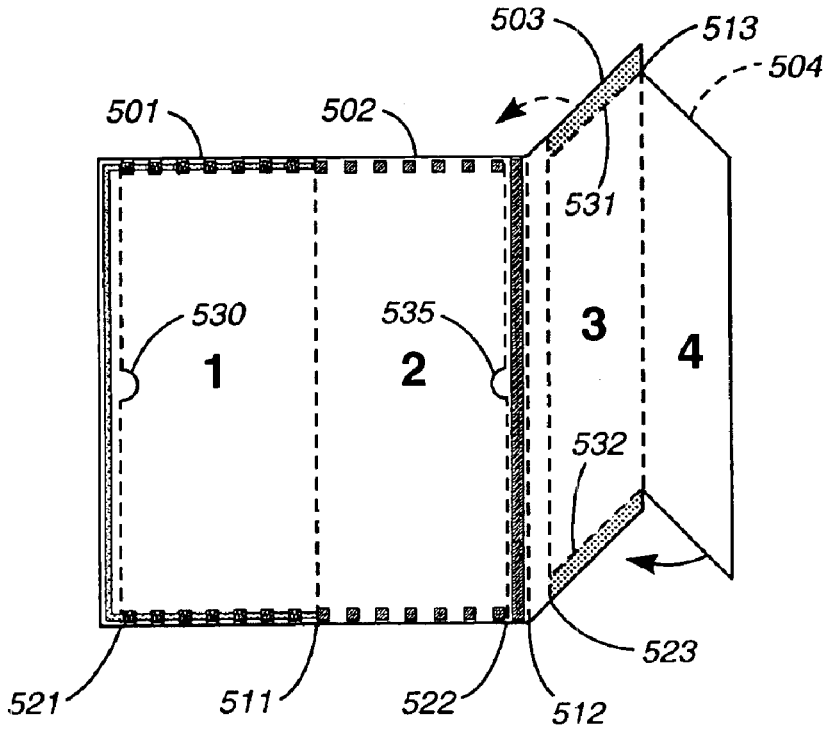
FIG. 18 shows an angled view of the back of the mailing form of FIG. 16 during the second step of the folding process.

FIG. 18 shows an angled view of the back of the mailing form of FIG. 16 during the second step of the folding process. The next step in the folding process includes folding the fourth panel 504 along the fold line 513 such that the front face of the fourth panel 504 contacts the front face of the third panel 503 and folding the third panel 503 along the fold line 512 such that the back face of the third panel 503 contacts the back face of the second panel 502. When the back face of the third panel 503 contacts the back face of the second panel 502, the adhesive deposited onto the back face of the second panel 502 contacts and bonds with the paper of the back face of the third panel 503. Specifically, the adhesive along the edges of the second panel 502 adheres to the area of the third panel 503 bounded by the perforations 531, 532 and the edges of the third panel 503. In this manner, the mailer of FIG. 18 is secured in folded form.

Figure 19:
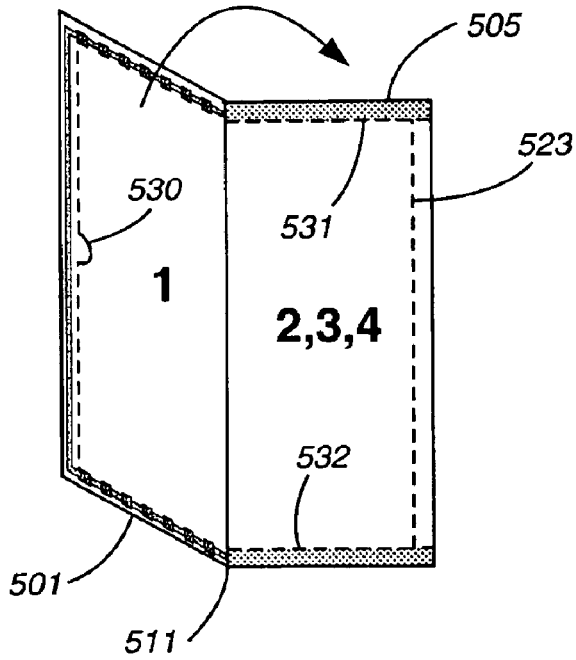
FIG. 19 shows an angled view of the back of the mailing form of FIG. 16 during the final step of the folding process.

FIG. 19 shows an angled view of the back of the mailing form of FIG. 16 during the final step of the folding process. FIG. 19 also shows the result of the folding steps described in FIG. 18. Note that in FIG. 19, the perforations 522 and 523 are aligned. Further note that the sides of the fourth panel 504 are aligned with the perforations 531 and 532. Thus, the right panel of the illustration of FIG. 19 shows the back face of the fourth panel 504 and the outer edges of the front face of the third panel 503.

Returning to the folding process, the next step in the folding process includes folding the first panel 501 along the fold line 511 such that the back face of the first panel 501 contacts the back face of the fourth panel 504. When the back face of the first panel 501 contacts the back face of the fourth panel 504, the adhesive deposited onto the back face of the first panel 501 contacts and bonds with the paper of the front face of the third panel 503. Specifically, the adhesive along the edges of the first panel 501 adheres to the outer edges of the front face of the third panel 503. In this manner, the mailer of FIG. 19 is secured in folded form.

Figure 20:
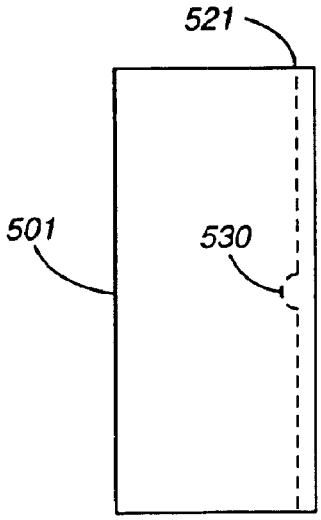
FIG. 20 shows a top view of the mailing form of FIG. 16 in fully folded form.

FIG. 20 shows a top view of the mailing form of FIG. 16 in fully folded form, wherein the mailing form is prepared for mailing. FIG. 20 also shows the result of the folding steps described in FIG. 19. Note that in FIG. 20, the perforations 521, 522 and 523 are aligned. Also note that the die cuts 530 and 535 are aligned. FIG. 20 shows the front face of the first panel 501.

Figure 21:
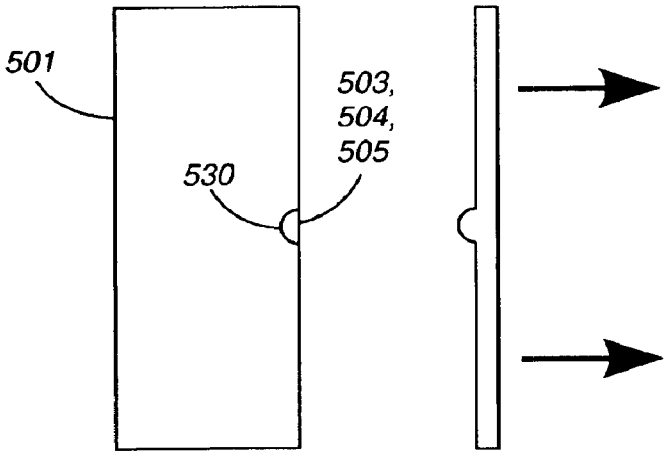
FIG. 21 shows a top view of the mailing form of FIG. 16 in fully folded form, during the first step of the document extraction process.

FIG. 21 shows a top view of the mailing form of FIG. 16 in fully folded form, during the first step of the document extraction process. FIG. 21 shows the tearing of the perforations 521, 522 and 523, which are aligned, and the exposing of the documents inside the mailer, i.e., the third through fourth panels 503–504. Note that the third through fourth panels 503–504 are exposed through the semicircular areas remaining from removal of die cuts 530 and 535.

Figure 22:
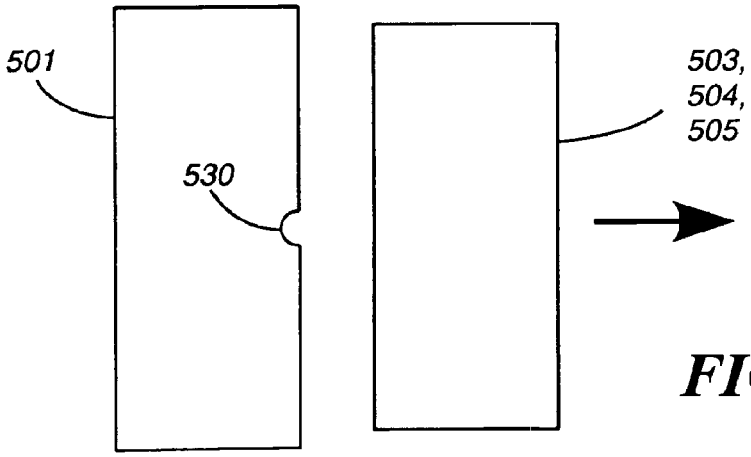
FIG. 22 shows a top view of the mailing form of FIG. 16 in fully folded form, during the final step of the document extraction process.

FIG. 22 shows a top view of the mailing form of FIG. 16 in fully folded form, during the final step of the document extraction process. In this step, a recipient pulls on the third through fourth panels 503–504, specifically on the area of those panels that are exposed through the semicircular areas remaining from removal of die cuts 530 and 535. Upon pulling by the recipient, the third through fourth panels 503–504 are released, as the perforations 531, 532 and 523 are broken. This allows the recipient to extract the document.

CONCLUSION

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

What is claimed is:

1. A mailing form for use with a simplex non-impact printer to facilitate a mailing of a document, the mailing form comprising:

a ply having a front face and a back face, wherein the ply includes a first panel, a second panel, and a third panel of substantially a same area;

a releasable substrate disposed on the front face of the first panel;

wherein the first panel is separated from the second panel by a first fold line, and the second panel separated from the third panel by a second fold line;

wherein at least one of the front face of the second panel and the front face of the third panel includes at least one area for receiving variable information thereon;

wherein both the back face of the first panel and the back face of the second panel have a peripheral edge with at least a portion of an adhesive pattern disposed thereon;

wherein both the back face of the first panel and the back face of the second panel have a peripheral edge with at least a portion of an adhesive-release pattern disposed thereon to substantially correspond to the locations of the adhesive pattern disposed on the back face of the first panel and the back face of the second panel so that a temporary seal is formed when the first panel is folded over the first fold line whereby the back face of the first panel is in contact with the back face of the second panel for printing through a simplex non-impact printer;

adhesive disposed on the releasable substrate such that when the mailing form is folded along the first fold line so that the front face of the first panel contacts the front face of the second panel, the adhesive secures the mailing form in folded form, and wherein when the mailing form is unfolded along the first fold line, the adhesive is transferred to the front face of the second panel;

wherein after printing, the first panel and the second panel are unfoldable by breaking the temporary seal and the third panel folded over the second fold line so that the third panel adheres to the adhesive pattern on the back face of the second panel and is sandwiched between the first panel and the second panel and securely held therebetween by the adhesive pattern disposed on the back face of the first panel and the back face of the second panel for mailing.

2. The mailing form of claim 1, wherein the variable information on the front face of the third panel includes any one of:

a check;

an account statement;

a tax form;

a certified mail form;

a letter;

a notice; and an invoice.

3. The mailing form of claim 1, wherein the variable information on the back face of the first panel includes at least one of:

a sender address;

a recipient address; and postage indicia.

4. The mailing form of claim 1, wherein the ply includes a fourth panel which is separated from the third panel by a third fold line and wherein after printing, the fourth panel is folded over the third fold line so that the back face of the fourth panel lies on of the back face of the third panel.

5. The mailing form of claim 4, wherein the front face of the fourth panel includes at least one area for receiving variable information thereon.

6. The mailing form of claim 4, wherein a width of the fourth panel is less than a width of the third panel.

7. The mailing form of claim 4, wherein the ply includes a fifth panel which is separated from the fourth panel by a fourth fold line and wherein after printing the fifth panel is folded over the fourth fold line so that the front face of the fifth panel lies on of the front face of the third panel.

8. The mailing form of claim 7, wherein the front face of the fifth panel includes at least one area for receiving variable information thereon.

9. The mailing form of claim 7, wherein a width of the fifth panel is less than a width of the third panel.

10. A mailing form for use with a simplex non-impact printer to facilitate a mailing of a document, the mailing form comprising:

a ply having a front face and a back face, wherein the ply includes a first panel, a second panel, and a third panel of substantially a same area;

a first perforation along a top edge of the first panel, spanning an entire length of the first panel;

a second perforation along a bottom edge of the second panel, spanning an entire length of the second panel;

a third perforation along a top edge of the third panel, spanning an entire length of the third panel;

a fourth perforation along a first fold line; and wherein the first panel is separated from the second panel by the first fold line, and the second panel separated from the third panel by a second fold line;

wherein at least one of the front face of the second panel and the front face of the third panel includes at least one area for receiving variable information thereon;

wherein both the back face of the first panel and the back face of the second panel have a peripheral edge with at least a portion of an adhesive pattern disposed thereon;

wherein both the back face of the first panel and the back face of the second panel have a peripheral edge with at least a portion of an adhesive-release pattern disposed thereon to substantially correspond to the locations of the adhesive pattern disposed on the back face of the first panel and the back face of the second panel so that a temporary seal is formed when the first panel is folded over the first fold line whereby the back face of the first panel is in contact with the back face of the second panel for printing through a simplex non-impact printer; and wherein after printing, the first panel and the second panel are unfoldable by breaking the temporary seal and the third panel folded over the second fold line so that the third panel adheres to the adhesive pattern on the back face of the second panel and is sandwiched between the first panel and the second panel and securely held therebetween by the adhesive pattern disposed on the back face of the first panel and the back face of the second panel for mailing.

11. The mailing form of claim 10, wherein when the mailing form is folded along the first fold line, folded along the second fold line, and folded along the third fold line such that the back face of the first panel contacts the back face of a fourth panel, the first perforation, the second perforation and the third perforation are aligned.

12. The mailing form of claim 10, wherein an overall length of the ply corresponds to one of 11 inches, 11.69 inches (A4), and 14 inches, when the first panel is temporarily sealed with the second panel.

13. The mailing form of claim 10, wherein the variable information on the front face of the third panel includes any one of:

a check;

an account statement;

a tax form;

a certified mail form;

a letter;

a notice; and an invoice.

14. The mailing form of claim 10, wherein the variable information on the back face of the first panel includes at least one of:

a sender address;

a recipient address; and postage indicia.

* * * * *